United States Patent [19]

Heki et al.

[11] Patent Number: 4,863,839

[45] **Date of Patent: * Sep. 5, 1989**

[54] DIRECT POSITIVE COLOR IMAGE FORMING PROCESS

[75] Inventors: Tatsuo Heki; Noriyuki Inoue, both of Kanagawa, Japan

[73] Assignee: Fuji Photo Film Co., Ltd., Kanagawa, Japan

[ * ] Notice: The portion of the term of this patent subsequent to Dec. 6, 2005 has been disclaimed.

[21] Appl. No.: 85,493

[22] Filed: Aug. 14, 1987

[30] Foreign Application Priority Data

Aug. 14, 1986 [JP] Japan ..... 61-189650

[51] Int. Cl.[4] ..... G03C 5/24; G03C 7/26

[52] U.S. Cl. ..... 430/378; 430/406; 430/409; 430/410; 430/471; 430/547; 430/605

[58] Field of Search ..... 430/547, 217, 406, 409, 430/410, 411, 607, 611, 604, 605, 378

[56] References Cited

U.S. PATENT DOCUMENTS

| | | | |
|---|---|---|---|
| 3,761,267 | 9/1973 | Brewster et al. | 430/409 |
| 4,115,122 | 9/1978 | Adachi et al. | 430/596 |
| 4,444,871 | 4/1984 | Miyaoka et al. | 430/378 |
| 4,444,874 | 4/1984 | Silverman et al. | 430/409 |
| 4,471,044 | 9/1984 | Parton et al. | 430/217 |
| 4,643,965 | 2/1987 | Kubota et al. | 430/567 |

FOREIGN PATENT DOCUMENTS

| | | |
|---|---|---|
| 060222 | 9/1978 | Japan . |
| 208540 | 7/1984 | Japan . |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A process for forming direct positive color photographic image is disclosed whereby a color photographic material having on a support at least one previously unfogged internal latent image-type silver halide emulsion layer and at least color forming coupler is developed, after imagewise exposure, with a surface color developer containing an aromatic primary amine color developing agent while applying thereto a fogging treatment, with or without the presence of a nucleating agent, before or during the development step, and bleaching and fixing (or blixing) the color photographic material, wherein the pH of the surface color developer is not higher than 11.2, the color image forming coupler is a compound which is substantially non-diffusible and forms and releases a dye causing oxidative coupling with the aromatic primary amine color developing agent, and the surface of the silver halide in the internal latent image-type silver halide has been gold-sensitized.

4 Claims, No Drawings

DIRECT POSITIVE COLOR IMAGE FORMING PROCESS

FIELD OF THE INVENTION

This invention relates to an image forming process for obtaining direct positive color images by color development processing, after imagewise exposure, a direct positive silver halide color photographic material.

BACKGROUND OF THE INVENTION

A photographic process obtaining direct positive images without requiring an additional reversal processing step or a negative film is well-known A conventional process which is used for forming positive images using a direct positive silver halide photographic material is mainly classified into the following two types, apart from specific ones, considering their practical utility.

In one type of photographic process, a direct positive image is obtained by using a previously fogged silver halide emulsion and, after development, destroying fogged nuclei (latent images) at exposed portions by utilizing solarization or the Herschell effect.

In another type of photographic process, a direct positive image is obtained by using an unfogged internal latent image-type silver halide emulsion and, after image-wise exposure, applying surface development after or during applying fogging treatment.

Also, the aforesaid internal latent image-type silver halide photographic emulsion include a silver halide photographic emulsion of a type having sensitivity speck mainly in the inside of silver halide grain and forming the latent image mainly in the inside of the grain by light-exposure.

The latter type process is generally high in sensitivity as compared to the former type process and is suitable for uses requiring high sensitivity. The present invention relates to the latter type.

Various techniques are known in the technical field. For example, these techniques are described in U.S. Pat. Nos. 2,592,250, 2,466,957, 2,497,875, 2,588,982, 3,317,322, 3,761,266, 3,761,276, 3,796,577, British Pat. Nos. 1,151,363, 1,150,553, 1,011,062, *Research Disclosure,* RD No. 15162 (November, 1976), ibid., RD No. 17643 (December, 1978), etc.

By using these known processes, relatively high sensitivity direct positive photographic light-sensitive materials can be obtained.

Also, details of the mechanics of forming direct positive images are described in T. H. James, *The Theory of the Photographic Process,* 4th edition, Chapter 7, pp. 182–193, and U.S. Pat. No. 3,761,276.

That is, it is believed that photographic images (direct positive images) are formed at unexposed portions of a photographic light-sensitive material by selectively forming fogged nuclei on the surface only of the silver halide grains at the unexposed portions due to the surface desensitizing action caused by so-called internal latent images formed in the inside of the silver halide by a first imagewise exposure an then applying an ordinary so-called surface development process to the photographic light-sensitive material.

As a means for selectively forming fogged nuclei as described above, a so-called "light fogging method" applying a second light exposure onto the whole surface of a light-sensitive layer (as described, for example, in British Pat. No. 1,151,363) and a so-called "chemical fogging method" using a nucleating agent are known. The latter method is described, for example, in *Research Disclosure.* Vol. 151, RD No. 15162, pp. 76–78 (November, 1976).

Direct positive images are formed by applying a surface color development process to an internal latent image-type silver halide light-sensitive material after or during the application of a fogging treatment, using light or a nucleating agent, to the light-sensitive material and thereafter subjecting the light-sensitive material to a bleaching and fixing process (or blix process). After the fixing process or blix process, an ordinary wash process and/or a stabilization process is applied.

In such direct positive image formation using the light fogging method or chemical fogging method, the processing time is long since development speed is slow as compared with processing ordinary negative-type photographic light-sensitive materials. If the pH of the developer is lowered, the processing time becomes longer and hence it is not preferred to reduce the pH of the developer in the direct positive image formation.

Accordingly, it is difficult to obtain a direct positive image having high maximum image density and low minimum image density by using a developer having low pH and, hence, a process of shortening the processing time by increasing the pH and/or the temperature of developer has been employed.

Furthermore, when a direct positive photographic light-sensitive material is developable with a low-pH developer, photographic stability, that is, storage stability of unexposed light-sensitive material before photographic processing, is usually reduced and this is assumed to be caused by the fact that the emulsion components of such a light-sensitive material has slight activity in the pH range (usually from 5 to 7) during storage of the unexposed light-sensitive material. Accordingly, a photographic light-sensitive material which has a nucleating action in only high-pH development processing is necessary for obtaining good storage stability of the unexposed light-sensitive material. However, the above described processing property in a low-pH developer is inconsistent with good storage stability in the unexposed state and this problem is particularly acute in the chemical fogging method.

However, a developer having high pH generally causes the problem that the minimum image density of a direct positive image formed is increased. Also, under high pH, deterioration of a developing agent due to air oxidation is liable to occur, which results in greatly reducing development activity.

For solving these problems, compounds providing nucleating action at a pH even less than pH 12 are proposed in Japanese Patent Application (OPI) No. 69613/77 (corresponding to U.S. Pat. 4,115,122) (the term "OPI" as used herein referred to a "published unexamined Japanese patent application") and U.S. Pat. Nos. 3,615,615 and 3,850,638. However, even when these compounds are used, minimum image density is increased and, furthermore, these nucleating agents have a disadvantage that during the storage of the light-sensitive materials before processing, the nucleating agents react with silver halide or the nucleating agent itself is decomposed to reduce, finally, the maximum image density of the light-sensitive material after processing.

Other means for increasing development speed in direct positive image formation are as follows.

It is described in U.S. Pat. No. 3,227,552 that development speed for an intermediate density is increased by using hydroquinone derivatives.

Also, Japanese Patent Application (OPI) No. 70843/85 describes that the maximum image density is increased by adding a mercapto compound having a carboxylic acid group or a sulfonic acid group. However, the effect due to the addition of the aforesaid compound is small and, further, the pH of the developer in this case is 12.0, which is not low enough to be considered a reduction of the pH of the developer.

Japanese Patent Application (OPI) No. 134848/80 describes a light-sensitive material processed by a processing liquid (pH 12.0) containing a tetraazaindene compound in the presence of a nucleating agent to reduce the minimum image density, thereby the formation of re-reversed negative images is prevented.

However, a stable technique for obtaining a direct positive image having a high maximum image density by processing for a short period of time using a low-pH developer using any of the techniques described above or using a combination of these techniques along with a light-sensitive material for use in such a technique which has good storage stability in the unexposed state, has not yet been found.

On the other hand, various methods have been proposed in the field of the art for increasing development speed and coloring speed of the color developer. Methods which depend upon a color developing agent, which must be permeated into coupler-dispersed oil drops for finally forming dyes by causing coupling with couplers, combined with various kinds of additives for accelerating coloring by hastening the permeation of the color developing agent are known. One compound which is known to have particularly great color formation accelerating effect is benzyl alcohol. Benzyl alcohol has been used for processing various color photographic materials and has at present been used as a necessary component in the field of photographic processing.

Benzyl alcohol may dissolve in water to some extent, but is poor in water solubility. For improving solubility, diethylene glycol, triethylene glycol or alkanolamine have been widely used.

However, these compounds and benzyl alcohol itself have a high BOD value and COD value resulting in a substantial pollution load when processing the developer as waste liquid. Hence, in spite of the above-described color properties and solubility advantages, it is desired from the point of waste liquid processing to reduce or omit benzyl alcohol in the developer.

Furthermore, the solubility of benzyl alcohol is insufficient even using one of the aforesaid solvents, such as diethylene glycol, which results in increased work and time required for preparing the developer.

Also, if benzyl alcohol is carried over to a bleach bath or a blix bath from a development bath containing benzyl alcohol by light-sensitive materials and accumulates in the bleach bath or blix bath, the benzyl alcohol reacts in the bleach bath or blix bath to form a leuco compound according to the kind of a cyan dye formed by development, which results in reducing color density.

Furthermore, the accumulation of benzyl alcohol causes insufficient washing out of developer components. In particular, the accumulation of benzyl alcohol makes it difficult to wash out the color developing agents from color photographic material in the wash step and, hence, these remaining components cause deterioration of the storage stability of the color images formed.

From these reasons, reducing or removing benzyl alcohol in a color developer is a significant and desirable objective.

At present, benzyl alcohol has the problems described above and, on the other hand, shortening processing time is necessary to meet the demand for quick delivery of the finished product.

However, these requirements are not simultaneously satisfied by conventional techniques and if benzyl alcohol is removed from color developer and the development time is shortened, color density is, as a matter of course, greatly reduced.

SUMMARY OF THE INVENTION

An objective of this invention is, therefore, to provide a process for quickly and stably forming direct positive color images having a high maximum coloring density by processing a previously unfogged internal latent image-type silver halide color photographic material with a low pH color developer.

Another objective of this invention is to provide a process of quickly and stably forming direct positive color images by processing a previously unfogged internal latent image-type silver halide color photographic material having very good storage stability in the unexposed state with a color developer having low pH.

A further objective of this invention is to provide a process for forming direct positive color images in which the maximum image density, the minimum image density and color reproducibility are maintained even at different color development temperatures, pHs, and processing times.

A still further objective of this invention is to provide a direct positive color image forming process in which there is less reduction of color density, even when processing time is short, when using a color developer containing substantially no benzyl alcohol.

It has now been discovered that the aforesaid objectives can be attained by the present invention as set forth below.

The invention is a process for forming direct positive color images by developing, after imagewise exposure, a color photographic material having on a support at least one previously unfogged internal latent image type-silver halide emulsion layer and at least one color image forming coupler with a surface color developer containing an aromatic primary amine color developing agent, while applying thereto a fogging treatment, with or without the presence of a nucleating agent, before or during the development step, and then bleaching and fixing (or blixing) the color photographic material, wherein the pH of the surface color developer is not higher than 11.2, the color image forming coupler is a compound which is substantially non-diffusible and forms or releases a dye by causing oxidative coupling with the aromatic primary amine color developing agent, and the surface of the silver halide in the internal latent image-type silver halide emulsion has been gold-sensitized.

DETAILED DESCRIPTION OF THE INVENTION

According to this invention, processing of an internal latent image-type direct positive color photographic material by a low pH color developer becomes possible by using an internal latent image-type silver halide emulsion in which the surface of the silver halide in various internal latent image-type silver halide emulsions is gold-sensitized according to the present invention. Examples of internal latent image-type silver halide emulsions that may be used are conversion-type emulsion which were not subjected to surface chemical sensitization (see, e.g., U.S. Pat. No. 2,592,250, Japanese Patent Application (OPI) Nos. 134721/77 and 66218/78), conversion type shell-added silver halide emulsions which were not subjected to surface chemical sensitization (see, e.g., Japanese Patent Application (OPI) Nos. 127549/80 (corresponding to British Pat. No. 2,044,944), 9940/82 and 70221/83), core/shell-type emulsions or internal noble metal-doped core/shell type emulsions which were not subjected to surface chemical sensitization (such as, sulfur or selenium sensitization, reduction sensitization, noble metal sensitization, etc.), etc. That is, it has been discovered that according to this invention, in spite of processing with a low-pH color developer, direct positive images having a sufficiently high maximum coloring density are formed and the direct positive color photographic material for use in the photographic process has very good storage stability in the unexposed state. This storage stability is particularly pronounced when a quaternary salt-type nucleating agent is used.

Furthermore, it has also been discovered that a sufficient color density can astonishingly be attained in a short processing time period when processing the direct positive gold-sensitized color photographic material of the present invention, even when the color developer contains substantially no benzyl alcohol, which is an indispensable component in conventional photographic processing.

The term "color developer containing substantially no benzyl alcohol" means that the color developer contains less than 2 ml/liter, preferably less than 0.5 ml/liter of benzyl alcohol, and more preferably no benzyl alcohol.

The previously unfogged internal latent image-type silver halide emulsion for use in this invention is a silver halide emulsion containing silver halide grains, wherein the surfaces thereof are not previously fogged and latent images are mainly formed in the inside of the grains. In more practical terms, the maximum density in the previously unfogged internal latent image type silver halide emulsion, is determined by an ordinary photographic density measuring method, in which a definite amount (0.5 to 3.0 g/m$^2$ as Ag) of the silver halide emulsion is coated on a transparent support, the light-sensitive material is exposed for a definite period of time from 0.01 sec. to 10 sec., and is developed in the following Developer A (internal-type developer) for 5 minutes at 18° C. The maximum density is preferably at least 5 times and, ore preferably, at least 10 times the maximum density obtained when coating the same amount of the silver halide emulsion as above, exposing the light-sensitive material to light in the same manner as above, and developing in the following Developer B (surface-type developer) for 6 minutes at 20° C.

| Internal Developer A: | |
|---|---|
| Metol (N—methyl-p-aminophenol sulfate) | 2 g |
| Sodium sulfite (anhydrous) | 90 g |
| Hydroquinone | 8 g |
| Sodium carbonate (monohydrate) | 52.5 g |
| Potassium bromide | 5 g |
| Potassium iodide | 0.5 g |
| Water to make | 1 liter |
| Surface Developer B: | |
| Metol | 2.5 g |
| l-Ascorbic acid | 10 g |
| $NaBO_2\ 4H_2O$ | 35 g |
| Potassium bromide | 1 g |
| Water to make | 1 liter |

Specific examples of silver halide emulsions which can be used for the internal latent image-type silver halide emulsion used in the present invention are core/shell-type silver halide emulsions described, for example, in U.S. Pat. Nos. 3,761,266, 3,761,276, 3,850,637, 4,035,185, 4,395,478, 4,504,570, Japanese Patent Application (OPI) Nos. 60222/78, 136641/82 (corresponding to U.S. Pat. No. 4,431,730), 208540/84, and *Research Disclosure,* RD No. 23510 (November, 1983), page 236. The silver halide emulsions formed by gold-sensitizing the surface of the silver halide grains of these silver halide emulsions can be used in this invention.

Furthermore, the silver halide emulsions formed by gold-sensitizing the surface of the silver halide grains of internal noble metal-doped color/shell-type silver halide emulsions described, for example, in U.S. Pat. Nos. 3,317,322, 3,761,267, 4,444,874, Japanese Patent Application (OPI) Nos. 107641/85, 3137/86 (corresponding to European Pat. No. 122,983), and Japanese Patent Application No. 3642/86 can be used as the internal latent image-type emulsion in this invention.

A preferred internal latent image-type silver halide emulsion for use in this invention is a core/shell type silver halide emulsion and, in the core/shell type emulsion, the silver halide grains of the core emulsion are chemically sensitized or the inside of those grains are doped with (i.e., contain) a noble metal. Further, the surface of the silver halide grains of the shell of the core/shell type emulsion silver halide grains are at least gold-sensitized.

Gold sensitization in this invention can be performed by adding a compound containing gold ion, such as the acids of $AuCl_4^-$, $AuBr_4^-$, $Au(SCN)^-$, $Au(CN)_2^-$, $Au(S_2O_3)_2^{3-}$, etc., or the potassium or sodium salts thereof to the emulsion in an amount of from 1 to $10^{-4}$ millimol, preferably from $10^{-1}$ to $10^{-3}$ millimol per mol of silver according to a manner known in the art. Such gold sensitization is described, for example, in T. H. James, *The Theory of the Photographic Process,* pages 154–155, published by Macmillan Publishing Co., Inc., 1977, and Research Disclosure, RD No. 7643, page 23.

Gold sensitization is preferably performed for from minutes to 2 hours at a pAg of from 5 to 10, a pH of from 5 to 8, and a temperature of from 30° to 80° C. Also, gold sensitization can be performed together with other chemical sensitization, such as sulfur sensitization and reduction sensitization, preferably together with sulfur sensitization.

Also, the amount of the gold compound which is used for gold-sensitizing the core and the surface of the silver halide grains is preferably from $10^{-2}$ to $10^2$ mol/mol, more preferably from $10^{-1}$ to 10 mol/mol, and most preferably from $\frac{1}{2}$ to 2 mol/mol per one silver halide grain in terms of the surface/core value.

The silver halide grains for use in this invention may have a regular crystal form, such as cubic, octahedral, dodecahedral, tetradecahedral, etc., an irregular crystal form such as spherical, etc., or may be tabular silver halide grains having a length to width ratio of at least 5.

Also, the silver halide grains may have a form which is a composite of these various crystal forms or may be composed of a mixture of silver halide grains having different crystal forms.

As the silver halide for use in this invention, there are silver chloride, silver iodide, and a mixed silver halide and a preferred silver halide for use in this invention is a silver (iodo)bromide, a silver (iodo)chloride, or a silver chloro(iodo)-bromide containing no silver iodide or containing less than 3 mol % silver iodide.

The mean grain size of the silver halide grains in this invention is preferably from 0.1 μm to 2 μm and particularly preferably from 0.15 μm to 1 μm.

The grain size distribution may be narrow or broad, but it is preferred to use a so-called monodispersed silver halide emulsion having a narrow grain size distribution, in which more than 90% of the whole grains are within ±40%, preferably within ±20%, of the mean grain size by number or weight to improve graininess, sharpness, etc. Also, for satisfying the desired gradation for color photographic material, two or more kinds of monodispersed silver halide emulsions, each having a different grain size, can be used as a mixture thereof for one emulsion layer or can be used for separate layers, each having substantially the same color sensitivity. Furthermore, two or more kinds of polydispersed silver halide emulsion layers or a combination of a monodispersed silver halide emulsion and a polydispersed silver halide emulsion can be used as a mixture thereof for one emulsion layer or can be used for separate emulsion layer.

In the silver halide emulsion for use in this invention, chemical sensitization is applied to the surfaces of the silver halide grains by gold sensitization singly or together with other types of sensitization, such as sulfur or selenium sensitization, reduction sensitization, noble metal sensitization, etc. Detailed practical examples of other types of sensitization are described in the patents cited in *Research Disclosure,* RD No. 17643-III, page 23 (December, 1978).

The photographic emulsion for use in this invention may be spectrally sensitized with photographic sensitizing dye according to conventional methods. Particularly useful dyes are dyes belonging to cyanine dyes, merocyanine dyes and composite merocyanine dyes. These dyes can be used singly or as a combination thereof. Also, the aforesaid dye can be used with a super color sensitizer. Detailed practical examples of these dyes are described in the patents cited in *Research Disclosure,* RD No. 17643-IV, pp. 23–24 (December, 1978).

The photographic emulsion for use in this invention can contain an antifoggant or a stabilizer for preventing the formation of fog during the production, storage, and photographic processing of the color photographic material or for stabilizing the photographic performance thereof. Detailed practical examples of these additives are described in *Research Disclosure,* RD No. 17643-VI (December, 1978) and E. J. Birr, *Stabilization of Photographic Silver Halide Emulsions,* published by Focal Press, 1974.

For forming direct positive color images, various color couplers can be used. A useful color coupler is a compound which forms or release a dye by causing a coupling reaction with the oxidation product of an aromatic primary amine color developing agent and is substantially non-diffusible. It is preferred that the dye formed or released is substantially non-diffusible.

Typical examples of useful color couplers are naphtholic or phenolic compounds, pyrazolone or pyrazoloazole series compounds, and closed chain or heterocyclic ketomethylene compounds. Specific examples of the cyan, magenta, and yellow couplers which can be used in this invention are described in *Research Disclosure,* RD No. 17643, VII-D, page 25 (December, 1978), ibid., RD No. 18717 (November, 1979), and Japanese Patent Application No. 32462/86 and the patents cited therein.

As the yellow couplers which can be used in this invention, oxygen atom releasing type or nitrogen atom releasing type 2-equivalent yellow couplers are preferred. In particular, the α-pivaloylacetanilide series yellow couplers are excellent in fastness, particularly light-fastness of colored dyes. On the other hand, the α-benzylacetanilide series yellow couplers give high color density.

Also, the 5-pyrazolone series magenta coupler which can be preferably used in this invention is a 5-pyrazolone series magenta coupler (particularly, a sulfur releasing type 2-equivalent coupler), the 3-position of which is substituted by an arylamino group or an acylamino group.

Furthermore, as the pyrazoloazole series magenta coupler which can be preferably used in this invention, pyrazolo[5,1-c][1,2,4]triazoles described in U.S. Pat. No. 3,725,067 are preferred, imidazo[1,2-b]pyrazoles described in U.S. Pat. No. 4,500,630 are more preferred because of less yellow side absorption and greater light-fastness of the colored dyes formed. Pyrazolo[1,5-b][1,2,4]triazoles described in U.S. Pat. No. 4,540,654 are particularly preferred.

As the cyan coupler which can be preferably used in this invention, there are naphtholic and phenolic cyan couplers described in U.S. Pat. Nos. 2,474,293 and 4,052,212, and phenolic cya couplers having an alkyl of two or more carbon atoms at the meta-position of the phenol nucleus described in U.S. Pat. No. 3,772,002. Also 2,5-diacylamino-substituted phenolic cyan couplers are preferred because of fastness of the color image.

Moreover, colored couplers for correcting unnecessary absorptions of the dyes formed in the short wavelength region, couplers giving colored dyes a proper diffusibility, non-coloring couplers, DIR couplers releasing a development inhibitor with the coupling reaction, couplers releasing a development accelerator, and polymerized couplers can also be used in this invention.

The amount of the color coupler is in the range of from 0.001 to 1 mol per mol of light-sensitive silver halide, with from 0.01 to 0.5 mol of a yellow coupler, from 0.003 to 0.3 mol of magenta coupler, and from 0.002 to 0.3 mol of a cyan coupler per mol of the light-sensitive silver halide being preferred.

Specific examples of preferred yellow couplers are illustrated below.

(Y-1)
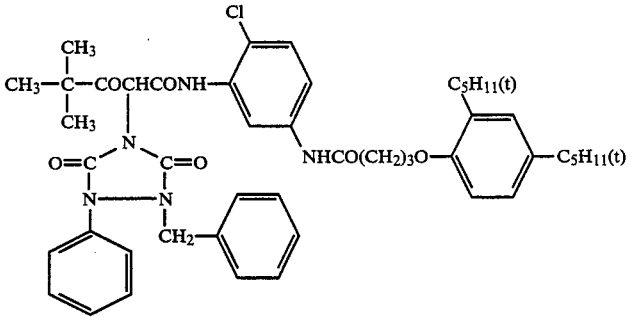
(Y-2)
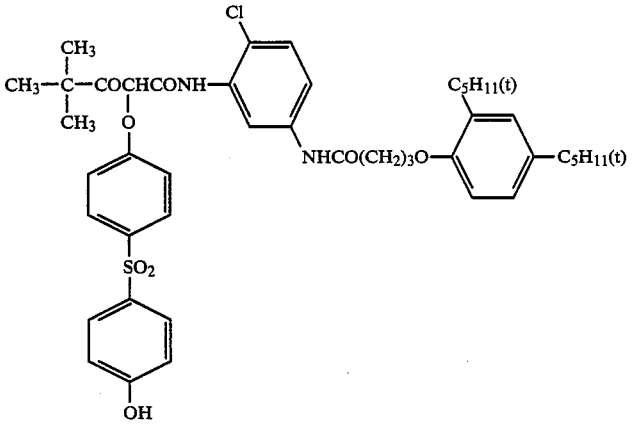
(Y-3)
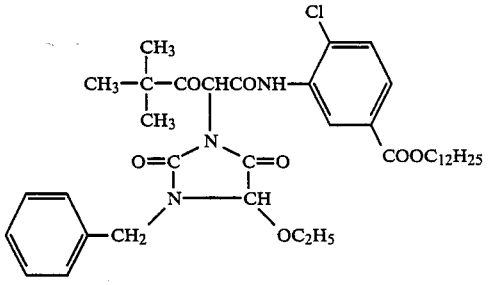
(Y-4)
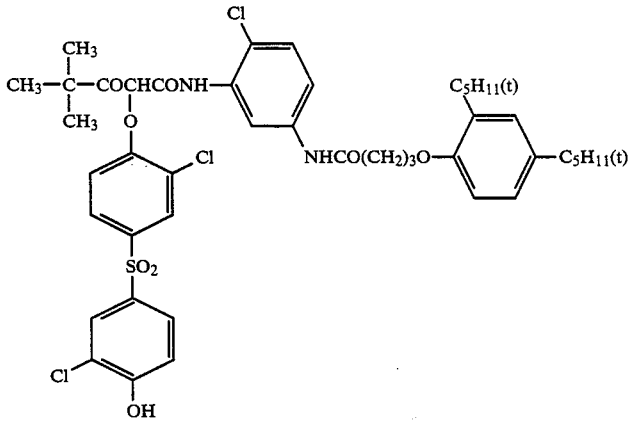

-continued
(Y-5)
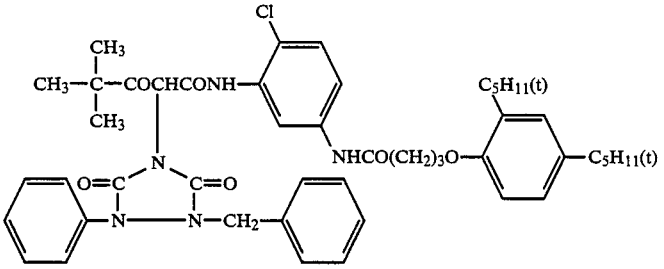
(Y-6)
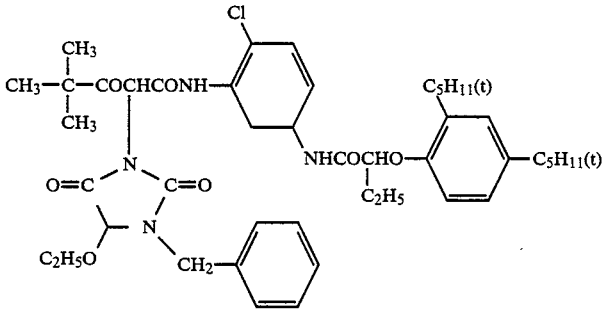
(Y-7)
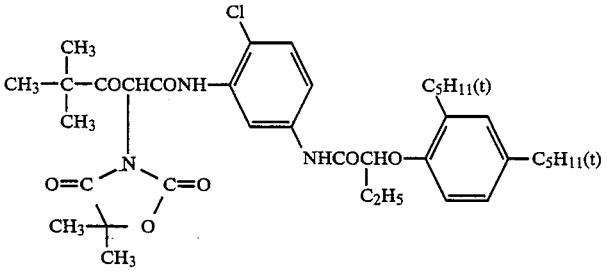
(Y-8)
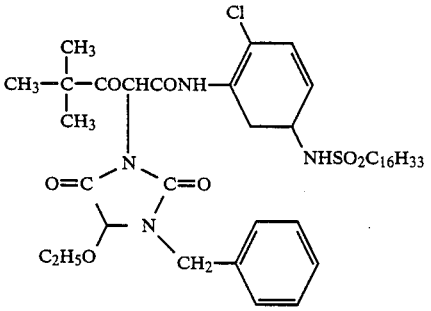
(Y-9)
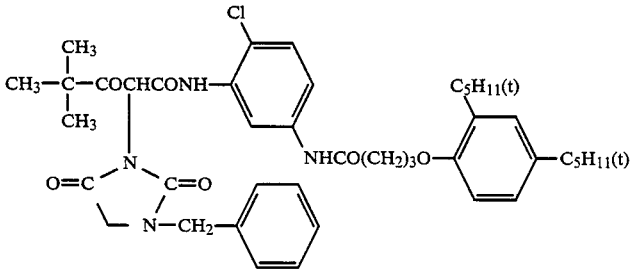

-continued
(Y-10)
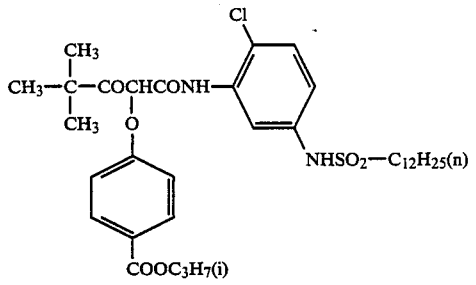
(Y-11)
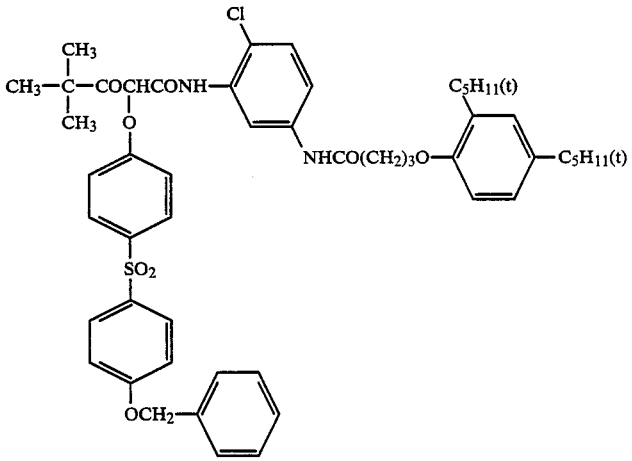
Specific examples of preferred magenta couplers are illustrated below.
(M-1)
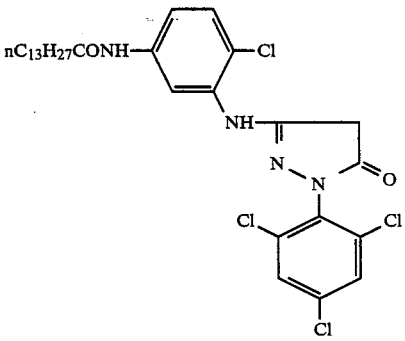
(M-2)
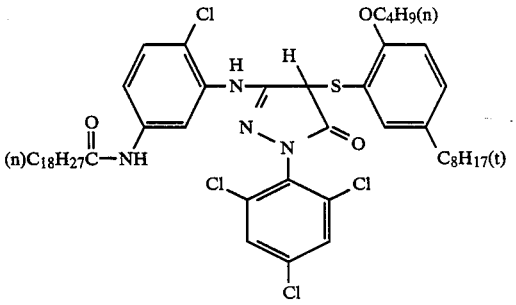

-continued
(M-3)
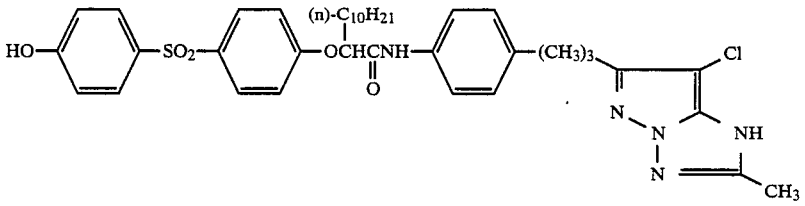
(M-4)
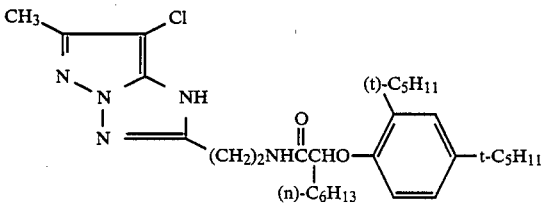
(M-5)
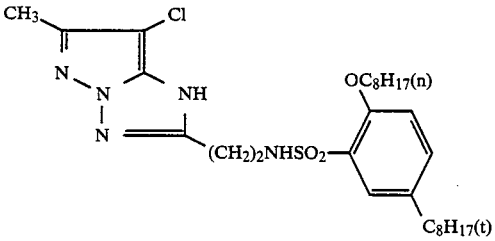
(M-6)
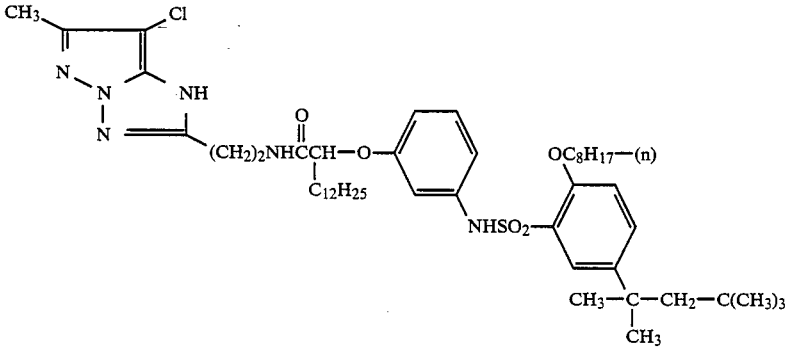
(M-7)
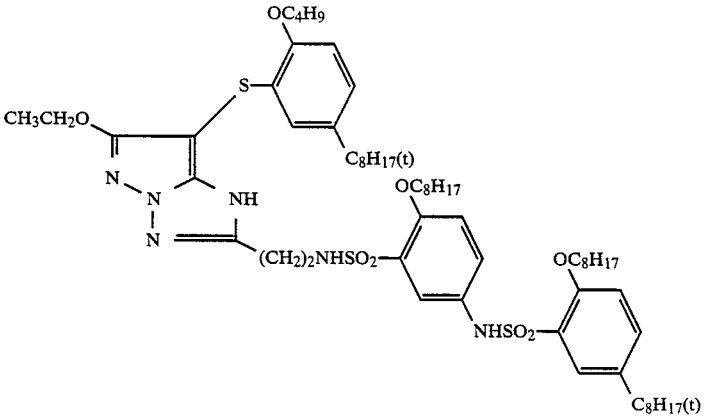

-continued
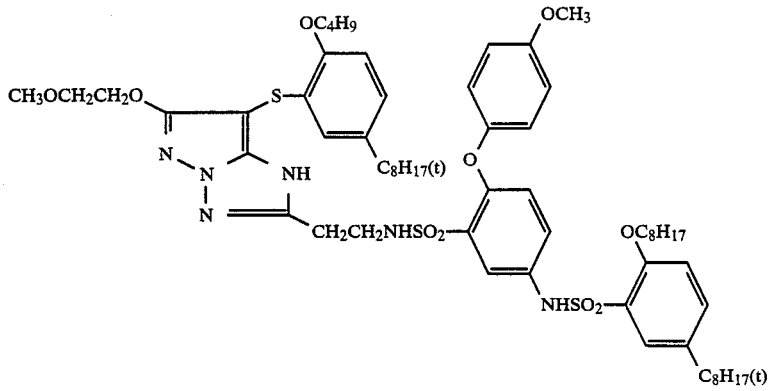
(M-8)
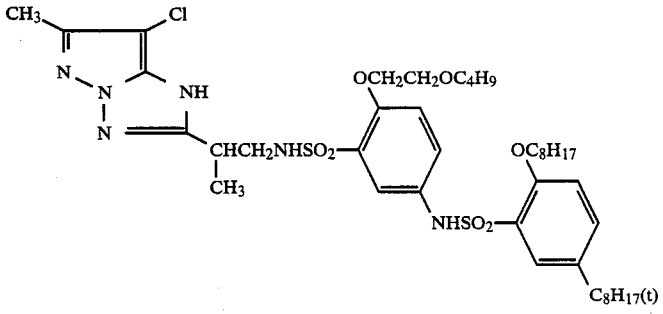
(M-9)
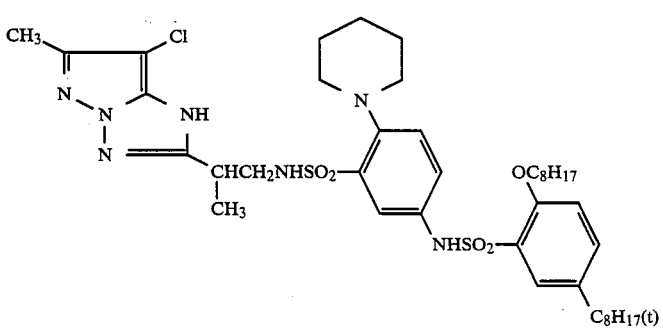
(M-10)
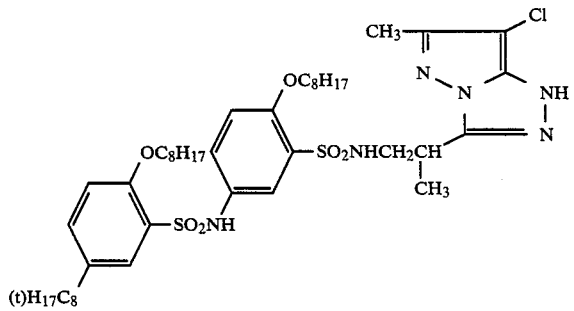
(M-11)

-continued
(M-12)
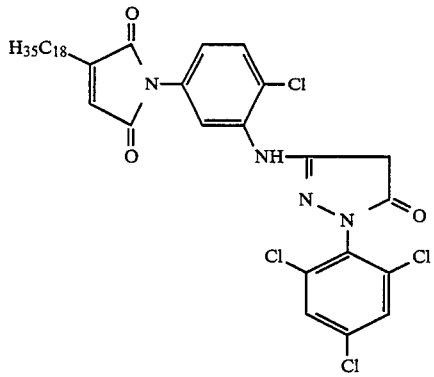
(M-13)
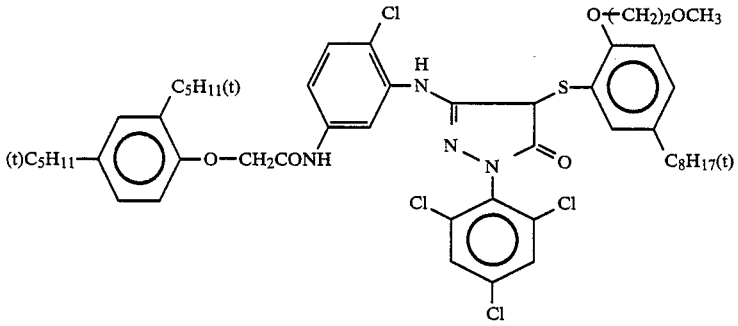
(M-14)
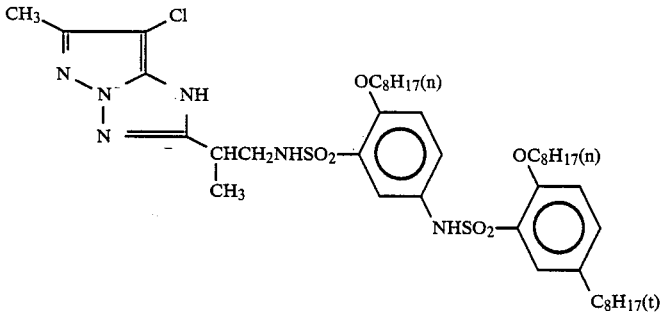
(M-15)
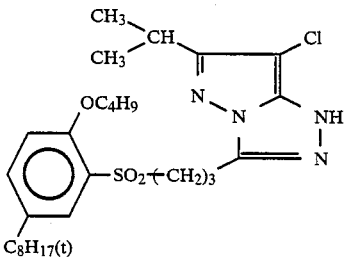
Specific examples of preferred cyan couplers are illustrated below.
(C-1)
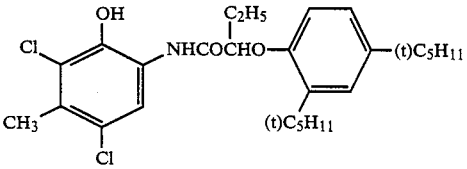

-continued
(C-2)
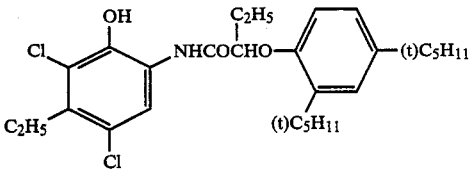
(C-3)
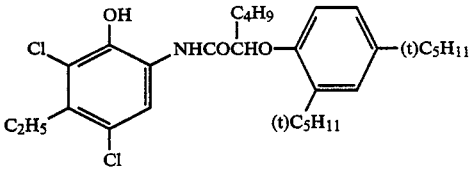
(C-4)
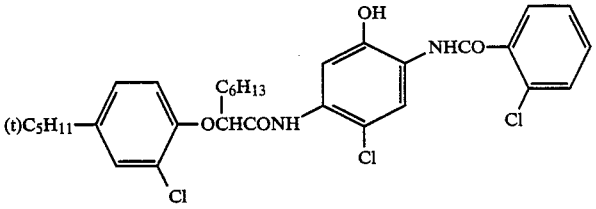
(C-5)
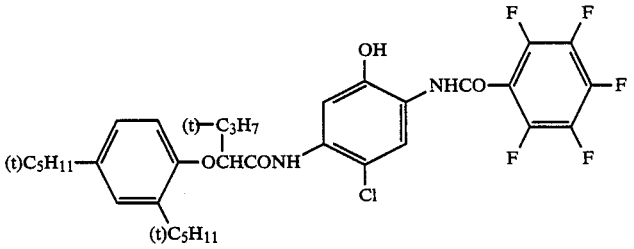
(C-6)
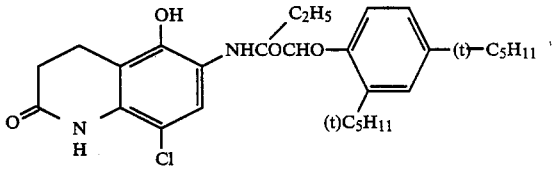
(C-7)
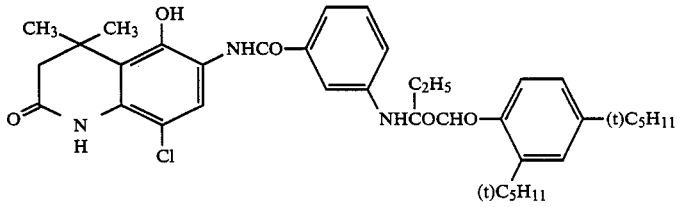
(C-8)
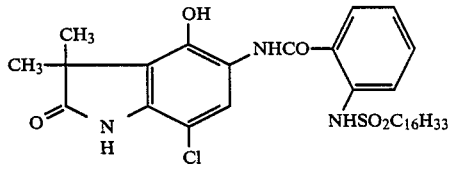
(C-9)
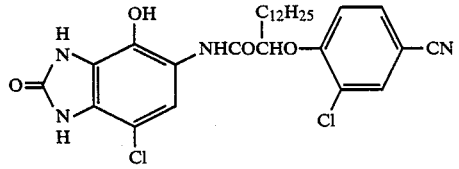

-continued (C-10)

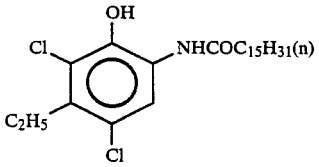

(C-11)

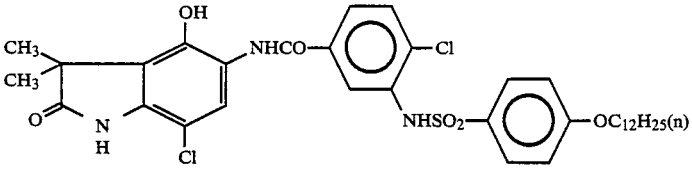

In this invention, color increasing agents can be used for improving the color properties of the coupler. Typical examples of the compound are described in Japanese Patent Application No. 32462/86, pp. 374–391.

In this invention, the coupler(s) are dissolved in a high-boiling organic solvent and/or a low-boiling organic solvent. The solution is dispersed by emulsification in an aqueous solution of gelatin or other hydrophilic colloid by high-speed stirring such as a homogenizer, etc., a mechanical fining means such as colloid mill, etc., or a technique utilizing ultrasonic waves. The emulsified dispersion is incorporated in a silver halide emulsion layer or other layer, preferably in a silver halide emulsion layer. A high-boiling organic solvent is not always necessary, but it is preferred to use the compounds described in Japanese Patent Application No. 32462/76, pp. 440–467.

In this invention, the couplers can be dispersed in an aqueous hydrophilic colloid solution by the method described in Japanese Patent Application No. 32462/86, pp. 468–475.

The color photographic material for use in this invention may contain hydroquinone derivatives, aminophenol derivatives, amines, gallic acid derivatives, catechol derivatives, ascorbic acid derivatives, non-coloring couplers, sulfonamidophenol derivatives, etc., as a color fog preventing agent or as a color mixing preventing agent.

Typical examples of the color fog preventing agent and color mixing preventing agent are described in Japanese Patent Application No. 32462/86, pp. 600–630.

For the color photographic materials for use in this invention, various fading preventing agents can be used. Typical examples of the organic fading preventing agent are hydroquinones, 6-hydroxychromans, 5-hydroxycoumarans, spirochromans, p-alkoxyphenols, bisphenols, hindered phenols, gallic acid derivatives, methylenedioxybenzenes, aminophenols, hindered amines, and the ether or ester derivatives of the aforesaid compounds obtained by silylating or alkylating the phenolic hydroxy groups of these compounds. Also, metal complexes such as (bissalicylaldoxymate) nickel complex salt and (bis-N,N-dialyldithiocarbamate) nickel complex salt can also be used as the fading preventing agent.

For preventing the deterioration of yellow dye images by heat, moisture, and light, the compound having both moieties of hindered amine and hindered phenol in one molecule as described in U.S. Pat. No. 4,268,593 gives good results. Also, for preventing the deterioration of magenta dye images, particularly by light, spiroindans described in Japanese Patent Application (OPI) No. 159644/81 (corresponding to U.S. Pat. No. 4,360,589) and chromans substituted by hydroquinone diether or hydroquinone monoether described in Japanese Patent Application (OPI) No. 89835/80 (corresponding to U.S. Pat. No. 4,264,720) give preferred results.

Typical examples of these fading preventing agents are described in Japanese Patent Application No. 32462/86, pp. 401–440. The compounds can attain their purpose by coemulsifying 5 to 100% by weight of the compound relative to the weight of the emulsion and a coupler and incorporating the emulsion into a light-sensitive emulsion layer.

For preventing the cyan dyes images from being deteriorated by heat and, in particular, by light, ultraviolet absorbent(s) are introduced into both layers adjacent to the cyan coloring emulsion layer. Also, ultraviolet absorbent(s) may be incorporated in a hydrophilic colloid layer such as a protective layer, etc. Typical examples of these compounds are described in Japanese Patent Application (OPI) No. 32462/86, pp. 391–400.

As a binder or protective colloid for the color photographic material in this invention, gelatin is advantageously used but other hydrophilic colloids can be used.

The color photographic materials for use in this invention can further contain dyes for preventing irradiation and halation, compounds which prevent problems caused by ultraviolet ray, plasticizers, optical whitening agents, matting agents, agents which prevent fogging caused by contact with air, coating aids, hardening agents, antistatic agents, friction reducing agents, etc. Typical examples of these additives are described in *Research Disclosure,* RD No. 17643, VIII to XIII, pp. 25–27 (December, 1978), and ibid., RD No. 18716, pp. 647–651 (November, 1979).

This invention can be applied to a multilayer multicolor photographic material having at least two silver halide emulsions, each having different spectral sensitivity on a support. A multilayer natural color photographic light-sensitive material usually has at least one red-sensitive emulsion layer, at least one green-sensitive emulsion layer, and at least one blue-sensitive emulsion layer on a support. The order of these. .layers can be optionally selected according to the purpose for which the multicolor photographic material is used. A preferred order of dis position of the layers are a red-sensitive layer, a green-sensitive layer, and a blue-sensitive layer or a green-sensitive layer, a red-sensitive layer, and a blue-sensitive layer, beginning from the support side. Also, each emulsion layer described above may be composed of two or more emulsion layers, each having a different sensitivity. Furthermore, a light-insensitive layer may exist between or among two or more light-sensitive emulsion layers. A red-sensitive emulsion layer usually contains a cyan-forming coupler, a green-sensitive emulsion layer usually contains a magenta-forming coupler, and a blue-sensitive emulsion layer usually contains a yellow-forming coupler, but other combinations can be used as the case may be.

The color photographic material for use in this invention preferably has appropriate auxiliary layers, such as protective layer(s), interlayers, a filter layer, an antihalation layer, a back layer, a white light reflecting layer, etc., in addition to silver halide emulsion layers.

The aforesaid photographic emulsion layers and other layers are coated on a support as described in *Research disclosure,* RD No. 17643, XVII, page 28 (December, 1978), European Pat. No. 182,253 and Japanese Patent Application (OPI) No. 97655/86. Also, in this case, coating methods described in *Research Disclosure,* RD No. 17643, XV, pp. 28–29 (December, 1978) can be used.

This invention can be applied to various color photographic light-sensitive materials. Typical examples thereof are color reversal photographic films for slides or television and color reversal photographic papers. Also, the invention can be applied to full color copying machines and a color hard copy for storing CRT images. Furthermore, the invention can be applied to black-and-white light-sensitive materials utilizing a mixture of three color couplers described in *Research Disclosure,* RD No. 17123 (July, 1978).

As the fogging treatment which is employed for the direct positive image forming process of this invention, there are the "light fogging method" using light and the "chemical fogging method" using a nucleating agent. Also, a color photographic material containing a nucleating agent may be subjected to fogging exposure.

The fogging exposure in this invention (consisting of overall light exposure) is performed before development and/or during development after imagewise exposure. The color photographic material which has been subjected to imagewise exposure is exposed to overall light exposure while immersed in a developer or a pre-bath for development, or is subjected to light exposure after withdrawing it from such a liquid before drying, but is most preferably light exposed in a developer.

As the light source for the fogging exposure, any light source emitting light within the range of wavelengths to which the color photographic materials are light-sensitive may be used. Generally, a fluorescent lamp, a tungsten lamp, a xenon lamp, sunlight, etc., can be used. Practical examples of these fogging methods are described, for example, in British Patent 1,151,363, Japanese Patent Publication Nos. 12709/70, 12710/70, 6936/83, Japanese Patent Application (OPI) Nos. 9727/73, 137350/81, 129438/82, 62652/83, 60739/83, U.S. Patent 4,440,851, European Pat. No. 89,101 A2, etc.

For color photographic material having light sensitivity over the entire light spectrum, light (near white light as close as possible) having high color rendering as described in Japanese Patent Application (OPI) Nos. 137350/81 and 70223/83 is preferably used. The intensity of the fogging light is from 0.01 to 2,000 lux, preferably from 0.05 to 30 lux, and more preferably from 0.05 to 5 lux. For the color photographic material of the present invention using a silver halide emulsion of higher sensitivity, light exposure of lower intensity is preferred. The intensity may be controlled by changing the intensity of the light source, by reducing the light intensity using various filters, by changing the distance between the color photographic material and the light source, or by changing the angle of the light sensitive material to the light source. By using weak light at the beginning of light exposure and then using strong light, the exposure time can be shortened.

It is better to expose the color photographic material to light after it has been dipped in a color developer or a pre-bath thereof for a period of time which is sufficient to permeate the liquid into the color photographic material. The time from dipping in the liquid to light exposure is generally from 2 seconds to 2 minutes, preferably from 5 seconds to 1 minute, and more preferably from 10 seconds to 30 seconds.

The exposure time for fogging is generally from 0.01 second to 2 minutes, preferably from 0.1 second to 1 minute, and more preferably from 1 second to 40 seconds.

In this invention, a nucleating agent which is used when applying a "chemical fogging method" can be incorporated in a color photographic material or in a processing liquid for a color photographic material, although incorporation in a color photographic material is preferred.

In this invention, the "nucleating agent" is a material causes the direct positive photographic material to form direct positive images by subjecting the unfogged internal latent image type silver halide emulsion to surface development processing.

When incorporating a nucleating agent in the color photographic material, it is preferred to incorporate it in the internal latent image-type silver halide emulsion layer, but it may also be incorporated in other layer such as an interlayer, a subbing layer, a back layer, etc., if it diffuses into a color photographic material and adsorbs on the silver halide thereof during coating or during processing.

When adding a nucleating agent to the processing liquid, it may be added to a color developer or to a low-pH pre-bath as described in Japanese Patent Application (OPI) No. 178350/83.

When incorporating a nucleating agent into the color photographic material, the amount thereof is preferably from $10^{-8}$ mol to $10^{-2}$ mol and, more preferably, from $10^{-6}$ mol to $10^{-3}$ mol per mol of silver halide.

Also, when adding the nucleating agent to a processing liquid, the amount thereof is preferably from $10^{-5}$ mol to $10^{-1}$ mol, and more preferably from $10^{-4}$ mol to $10^{-2}$ mol per liter of processing liquid. Furthermore, two or more nucleating agents may be used.

As a nucleating agent for use in this invention, all compounds which have been developed for nucleating an internal latent image-type silver halide can be used. Examples are the compounds described in *Research Disclosure,* RD No. 22534, pp. 50–54 (January, 1983). Also, these compounds may be used as a mixture of two or more.

Preferred nucleating agents for use in this invention are the compounds represented by formula (N-I) and (N-II) described below.

Formula (N-I) is represented as follows:

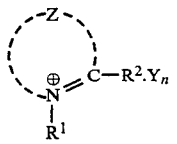

(N-I)

wherein Z represents a non-metallic atomic group necessary for forming a 5-membered or 6-membered heterocyclic ring which may be substituted with one or more substituents; $R^1$ represents an aliphatic group which may be substituted with one or more substituents; $R^2$ represents a hydrogen atom, an aliphatic group, or an aromatic group in which the aliphatic or aromatic group may be substituted with one or more substituents; with the proviso that at least one of the groups represented by said Z, $R^1$ and $R^2$ includes an alkinyl group, an acyl group, a hydrazine group, or a hydrazone group or said $R^1$ and $R^2$ combine with each other to form a 6-membered ring to form a dihydropyridinium skeleton; one or more of the substituents for said Z, $R^1$ and $R^2$ may contain a group represented by $X^1$-$(L^1)_m$, wherein $X^1$ represents an adsorption accelerating group for silver halide, $L^1$ represents a divalent linking group, and m represents 0 or 1; Y represents a paired ion for balancing the electric charge, so that the total change on formula (N-I) equals zero; and n represents 0 or 1.

The nucleating agents shown by formula (N-I) above are explained in more detail below.

The heterocyclic ring completed by Z includes, for example, a quinolinium nucleus, a benzothiazolium nucleus, a benzimidazolium nucleus, a pyridinium nucleus, a thiazolinium nucleus, a thiazolium nucleus, a naphthothiazolium nucleus, a selenazolium nucleus, a benzoselenazolium nucleus, an imidazolium nucleus, a tetrazolium nucleus, an indolenium nucleus, a pyrrolinium nucleus, an acridinium nucleus, a phenanthridinium nucleus, an isoquinolinium nucleus, an oxazolium nucleus, a naphthoxazolium nucleus, and a benzoxazolium nucleus.

Examples of the substituents for Z are an alkyl group, an alkenyl group, an aralkyl group, an aryl group, an alkinyl group, a hydroxy group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group, and an imino group. Z may have two or more substituents and the substituents may be the same or different. Also, the aforesaid substituent may be further substituted by the aforesaid substituent.

Preferred examples of the heterocyclic ring completed by Z are a quinolinium nucleus, a benzothiazolium nucleus, a benzimidazolium nucleus, a pyridinium nucleus, an acridinium nucleus, a phenanthridinium nucleus, and an isoquinolium nucleus.

More preferred examples of the heterocyclic ring are a quinolinium nucleus, a benzothiazolium nucleus, and a benzimidazolium nucleus. Even more preferred examples thereof are a quinolinium nucleus and a benzothiazolium nucleus. The most preferred example thereof is a quinolinium nucleus.

The aliphatic group in the $R^1$ and $R^2$ positions may be an unsubstituted alkyl group having 1 to 18 carbon atoms or a substituted alkyl group, said alkyl moiety having 1 to 18 carbon atoms. As the substituent for the alkyl group, there are those described above as the substituents for Z.

The aromatic group in the $R^2$ position may have 6 to 20 carbon atoms and examples thereof are a phenyl group, a naphthyl group, etc., which may be substituted by the substituent as described as the substituents for Z.

At least one of the groups in the Z, $R^1$ and $R^2$ positions has an alkinyl group, an acyl group, a hydrazine group or a hydrazone group or said $R^1$ and $R^2$ may form a 6-membered ring to form a dihydropyridinium skeleton as described above and they may be substituted by the substituents described above as the substituents for Z.

The preferred hydrazine group described above has an acyl group or a sulfonyl group as substituent.

The preferred hydrazone group described above has an aliphatic group or an aromatic group as substituent.

Preferred examples of the acyl group described above are a formyl group, an aliphatic ketone group or an aromatic ketone group.

The alkinyl substituents for $R^1$, $R^2$ or Z described above preferably has 2 to 18 carbon atoms and examples thereof are an ethynyl group, a propargyl group, a 2-butynyl group, a 1-methylpropargyl group, a 1,1-dimethylpropargyl group, a 3-butynyl group, a 4-pentynyl group, etc.

Furthermore, these groups may be substituted by the substituents described above as the substituents for Z. Examples thereof are a 3-phenylpropargyl group, a 3-methoxycarbonylpropargyl group, a 4-methoxy-2-butynyl group, etc.

Furthermore, it is preferred that at least one of the substituents for the groups or the rings in the Z, $R^1$ and $R^2$ positions is an alkinyl group or an acyl group, or $R^1$ and $R^2$ combine with each other to form a dihydropyridinium skeleton. It is most preferred that the one or more substituents for the groups or rings in the Z, $R^1$ or $R^2$ positions include at least one alkinyl group.

Examples of the preferred adsorption accelerating group for silver halide in the $X^1$ position described above are a thioamido group, a mercapto group, or a 5-membered or 6-membered nitrogen-containing heterocyclic group.

The thioamido adsorption accelerating group of $X^1$ is a divalent group which may be represented by

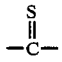

amino- and which may be part of a ring structure or may be a non-cyclic thiamido group. Examples of useful thioamido adsorption accelerating groups can be selected from those described in U.S. Pat. Nos. 4,030,925, 4,031,127, 4,080,207, 4,245,037, 4,255,511, 4,266,013, 4,276,364, *Research Disclosure,* Vol. 51, RD No. 15162 (November, 1976), ibid., Vol. 176, RD No. 7626 (December, 1978), etc.

Specific examples of the non-cyclic thioamido group are a thioureido group, a thiourethane group, a dithiocarbamic acid ester group, etc., and also specific examples of the cyclic thioamido group are a 4-thiazoline-2-thione group, a 4-imidazoline-2-thione group, a 2-thiohydantoin group, a rhodanine group, a thiobarbituric acid group, a tetrazoline-5-thione group, a 1,2,4-triazone-3-thione group, a 1,3,4-thiadiazoline-2-thione group, a 1,3,4-oxadiazoline-2-thione group, a benzimidazoline-2-thione group, a benzoxazoline-2-thione group, a benzothiazoline-2-thione group, etc. These groups may be further substituted with substituents such as an alkyl group, an alkenyl group, an aralkyl group, an aryl group, an alkinyl group, a hydroxy group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazine group, a hydrazone group, and an imino group.

The mercapto group of $X^1$ may be a group formed by directly bonding —SH to a group that Z, $R^1$ or $R^2$ represents, or a group formed by bonding —SH to a substituent of a group of Z, $R^1$ or $R^2$ Examples of the mercapto group are an aliphatic mercapto group, an aromatic mercapto group, and a heterocyclic mercapto group. When the atom adjacent to the carbon atom to which —SH is bonded in the heterocyclic ring is a nitrogen atom, the mercapto group has the same significance as the cyclic thioamido group as the tautomer thereof As the 5- to 6-membered nitrogen-containing heterocyclic group of $X^1$, there are 5- or 6-membered nitrogen-containing heterocyclic rings composed of a combination of nitrogen, oxygen, or sulfur and carbon atoms. Preferred examples of these heterocyclic rings are benzotriazole, triazole, tetrazole, indazole, benzimidazole, imidazole, benzothiazole, thiazole, benzoxazole, oxazole, thiadiazole, oxadiazole, triazine, etc. They can be further substituted by appropriate substituents. As such substituents, there are the substituents described above as the substituents for Z.

More preferred examples of the nitrogen-containing heterocyclic ring are benzotriazole, triazole, tetrazole, and indazole and the most preferred example thereof is benzotriazole.

The divalent linking group represented by $:^1$ is an atom or an atomic group containing at least one of C, N, S, and O. Practical examples thereof are an alkylene group, an alkenylene group, an alkinylene group, an arylene group —O—, —S—, —NH—, —N=, —CO—, —SO—, etc. (these groups may have a substituents) either singly or as a combination thereof The paired ion for charge balancing represented by Y is an optional anion capable of offsetting the positive charge generated by a quaternary ammonium salt in a heterocyclic ring and examples thereof are a bromide ion, a chloride ion, an iodide ion, a p-toluenesulfonate ion, an ethylsulfonate ion, a perchlorate ion, a trifluoromethanesulfonate ion, a thiocyanide ion, etc. In this case, n described above is 1. When the heterocyclic quaternary ammonium salt contains an anion substituent to form an inner salt such as a sulfoalkyl substituent or when the salt is a form of betaine, for instance, the paired ion is unnecessary and n is 0. When the heterocyclic quaternary ammonium salt has 2 anion substituents, for example, 2 sulfoalkyl groups, Y is a cationic paired ion such as an alkali metal ion (e.g., sodium ion, potassium ion, etc.) or an ammonium salt (triethylammonium, etc.).

Specific examples of the compounds represented by formula (N-I) described above are shown below, but the invention is not limited to them.

(N-1)

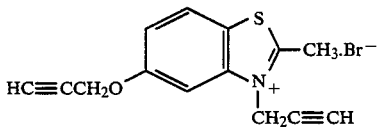

(N-2)

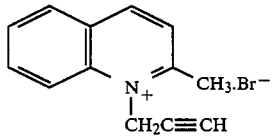

(N-3)

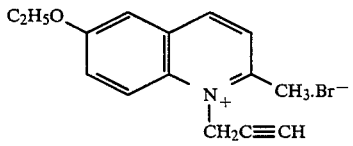

(N-4)

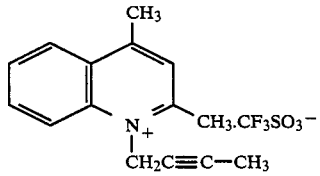

(N-5)

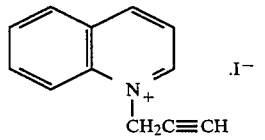

-continued
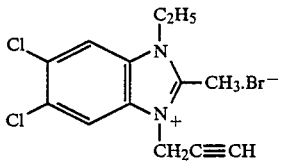
(N-6)
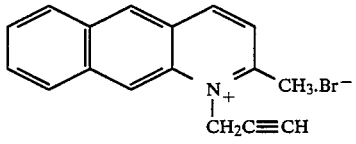
(N-7)
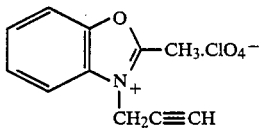
(N-8)
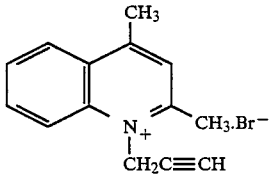
(N-9)
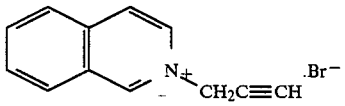
(N-10)
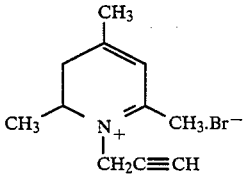
(N-11)
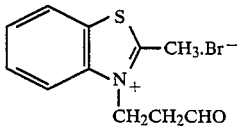
(N-12)
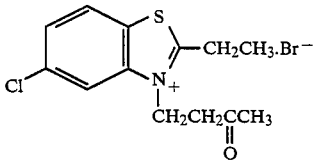
(N-13)
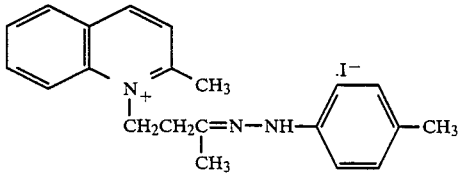
(N-14)

-continued
(N-15)
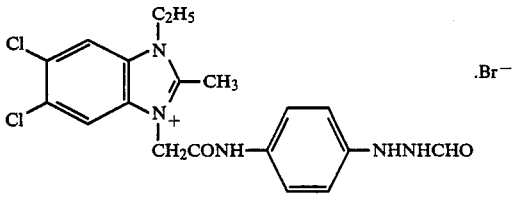
(N-16)
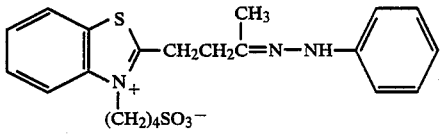
(N-17)
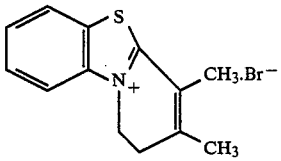
(N-18)
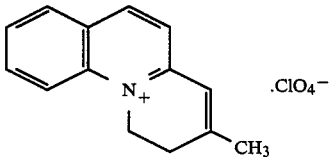
(N-19)
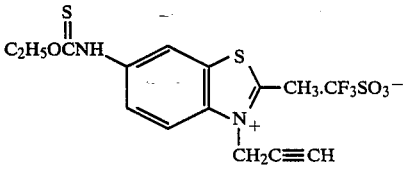
(N-20)
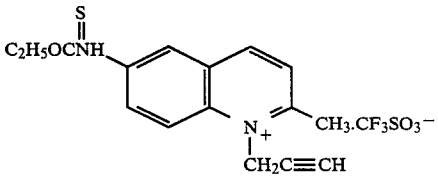
(N-21)
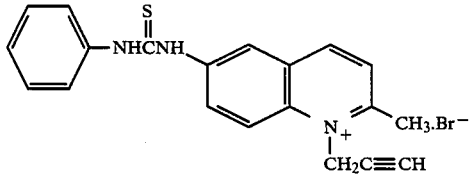
(N-22)
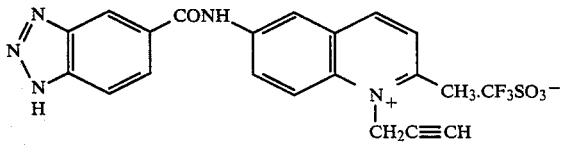

-continued
(N-23)
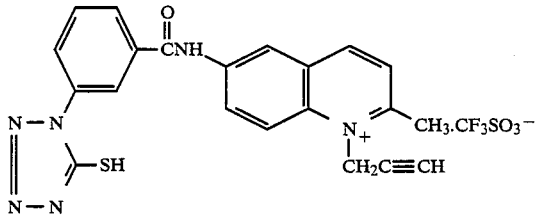
(N-24)
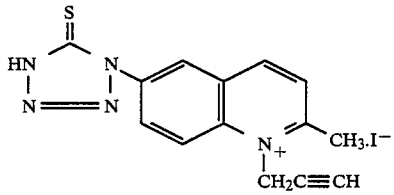
(N-25)
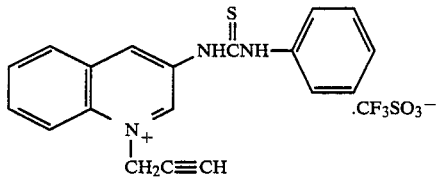
(N-26)
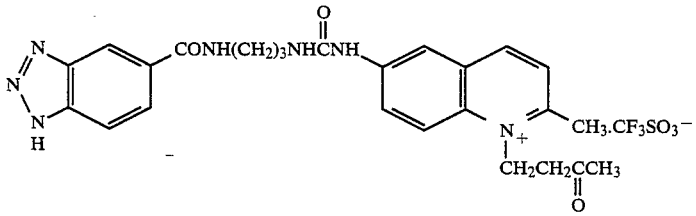
(N-27)
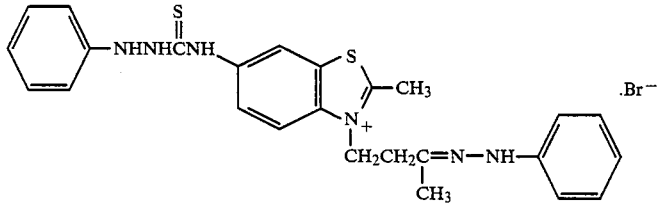
(N-28)
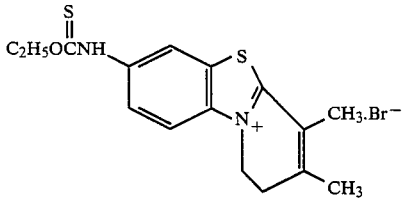
(N-29)
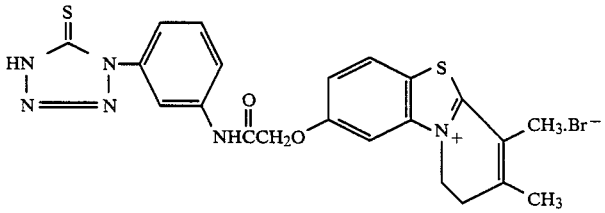

-continued (N-30)

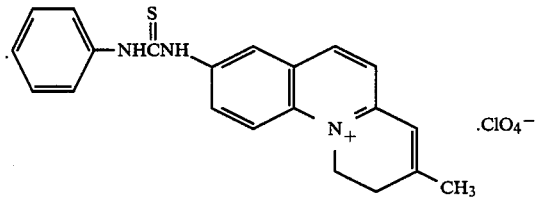

(N-31)

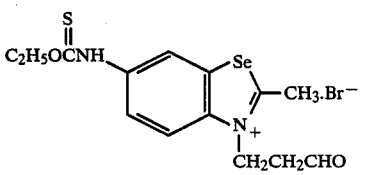

(N-32)

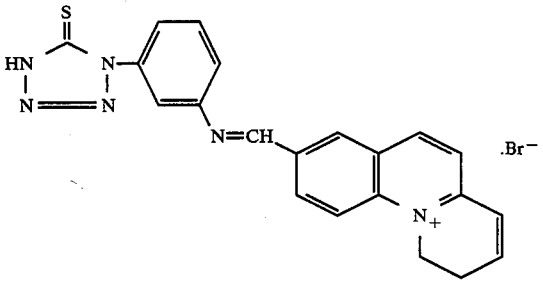

(N-33)

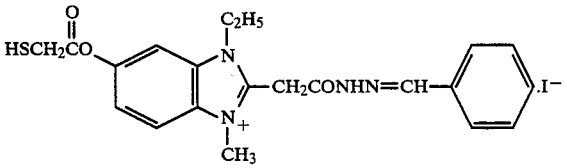

(N-34)

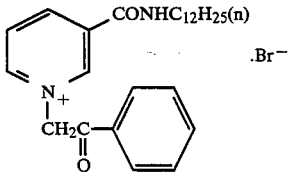

(N-35)

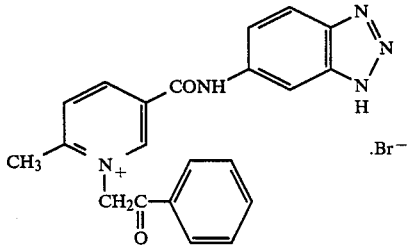

The compounds described above can be synthesized by the methods described in the patents cited in *Research Disclosure,* RD No. 22534, pp. 50–54 (January, 1983) and U.S. Pat. No. 4,471,044 and methods similar thereto The nucleating agents of formula (N-II) is represented as follows:

$$R^{21}-\underset{\underset{R^{23}}{|}}{N}-\underset{\underset{R^{24}}{|}}{N}-G-R^{22} \qquad \text{(N-II)}$$

wherein $R^{21}$ represents an aliphatic group, an alicyclic group, an aromatic group ,or a heterocyclic group; $R^{22}$ represents a hydrogen atom, an alkyl group, an aralkyl group, an aryl group, an alkoxy group, an aryloxy group or an amino group; G represents a carbonyl group, a sulfonyl group, a sulfoxy group, a phosphonyl group, or an iminomethylene group $$(HN{=}C\;);$$

and $R^{23}$ and $R^{24}$ both represent a hydrogen atom or one of said $R^{23}$ and $R^{24}$ is a hydrogen atom and the other is an alkylsulfonyl group, an arylsulfonyl group or an acyl group. The compound of the aforesaid formula may form a hydrazone structure

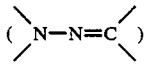

which includes G, $R^{23}$, $R^{24}$ and hydrazine nitrogen in its structure Also, the aforesaid groups may substituted by a substituent if a bond is available for substitution.

The aliphatic or alicyclic group of $R^{21}$ in formula (N-II) may be a straight chain, branched or cyclic alkyl, alkenyl or alkinyl group.

The heterocyclic ring of $R^{21}$ is a 3-membered to 10-membered saturated or unsaturated heterocyclic ring containing at least one of N, O and S and the heterocyclic ring may be a single ring or may form a condensed ring with other aromatic or heterocyclic ring.

The heterocyclic ring is preferably a 5-membered or 6-membered aromatic heterocyclic group and examples thereof are a pyridyl group, a quinolinyl group, an imidazolyl group, a benzimidazolyl group, etc.

The groups represented by $R^{21}$ may be substituted by a substituent such as alkyl group, an aralkyl group, an alkoxy group, an aryl group, a substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, and a carboxyl group. These substituents may combine each other to form a ring. The aforesaid substituents may be further substituted by the aforesaid substituents for Z.

The aromatic group shown by $R^{21}$ is a single ring or bicyclic aryl group and examples thereof are a phenyl group and a naphthyl group.

The preferred group of the $R^{21}$ is an aromatic group, an aromatic heterocyclic ring, an aryl-substituted methyl group, or an aryl group, more preferably an aryl group.

When G is a carbonyl group, the preferred group in the $R^{22}$ position is a hydrogen atom, an alkyl group (e.g., a methyl group, a trifluoromethyl group, a 3-hydroxypropyl group, a 3-methanesulfonamidopropyl group, etc.), an aralkyl group (e.g., an o-hydroxybenzyl group, etc.), an aryl group (e.g., a phenyl group, a 3,5-dichlorophenyl group, an o-methanesulfonylamidophenyl group, a 4-methanesulfonylphenyl group, etc.), etc., and is particularly preferably a hydrogen atom. Also, when G is a sulfonyl group, $R^{22}$ is preferably an alkyl group (e.g., a methyl group, etc.), an aralkyl group (e.g., an o-hydroxyphenylmethyl group, etc.), an aryl group (e.g., a phenyl group, etc.), or a substituted amino group (e.g., a dimethylamino group, etc.), etc.

As the substituent for the groups represented by $R^{22}$, there are the substituents illustrated above for $R^{21}$ and specific examples thereof are an amyl group, an amyloxy group, an alkoxycarbonyl group, an aryloxycarbonyl group, an alkenyl group, an alkinyl group, a nitro group, etc.

These substituents may be further substituted by these substituents. These substituents may also combine with each other to form a ring.

It is preferred that $R^{21}$ or $R^{22}$, in particular $R^{21}$, contains a non-diffusible group, such as a non-diffusible group used in couplers, etc. (i.e., a so-called ballast group). The ballast group has 8 or more carbon atoms and may be a combination of one or more of an alkyl group, a phenyl group, an ether group, an amido group, a ureido group, a urethane group, a sulfonamido group, a thioether group, etc.

$R^{21}$ or $R^{22}$ may have a group $X^2$—$(L_2)$—$_{m^2}$ [wherein $X^2$ has the same meaning as $X^1$ in formula (N-I) described above, and is preferably a thioamido group (excluding a thiosemicarbazide and substitutions thereof), a mercapto group or a 5-membered or 6-membered nitrogen-containing heterocyclic group, $L^2$ represents a linkage group and has the same meaning as $L^1$ in formula (N-I) described above, and $m^2$ is 0 or 1] for accelerating adsorption of the compound shown by formula (N-II) onto the surface of silver halide grains.

More preferably, $X^2$ is a cyclic thioamido group (i.e., a mercapto-substituted nitrogen-containing heterocyclic ring, such as, for example, a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, etc.), or a nitrogen-containing heterocyclic group (e.g., a benzotriazole group, a benzimidazole group, an indazole group, etc.).

$R^{23}$ and $R^{24}$ in formula (N-II) are preferably a hydrogen atom, an alkylsulfonyl group having not more than 20 carbon atoms, an arylsulfonyl group (preferably a phenylsulfonyl group or a phenylsulfonyl group substituted in such a manner that the sum of the Hammet's substituent constants becomes −0.5 or more), an acyl group having not more than 20 carbon atoms (preferably, a benzoyl group or a benzoyl group substituted in such a manner that the sum of Hammet's substituent constants becomes −0.5 or more), or a straight chain or branched, unsubstituted or substituted aliphatic acyl group or a substituted or unsubstituted alicyclic group. Examples of the substituents are a halogen atom, an ether group, a sulfonamido group, a carbonamido group, a hydroxy group, a carboxy group, a sulfonic acid group, etc.

$R^{23}$ and $R^{24}$ are most preferably a hydrogen atom.

Also, G in formula (N-II) is more preferably a carbonyl group.

Specific examples of the compounds represented by formula (N-II) described above are illustrated below, but the invention is not limited to these compounds.

(N-36)

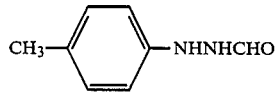

-continued
(N-37)
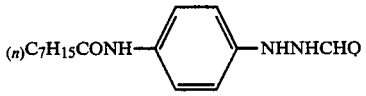
(N-38)
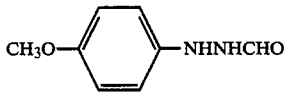
(N-39)
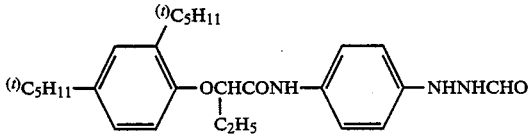
(N-40)
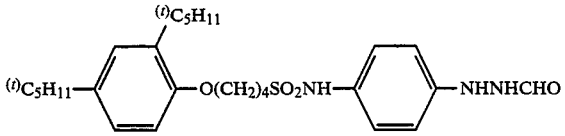
(N-41)
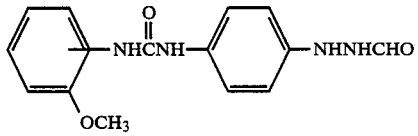
(N-42)
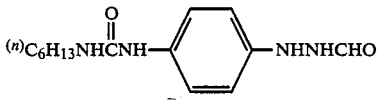
(N-43)
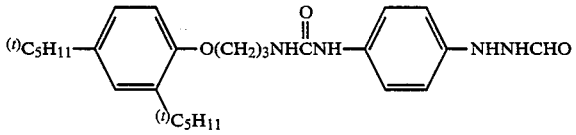
(N-44)
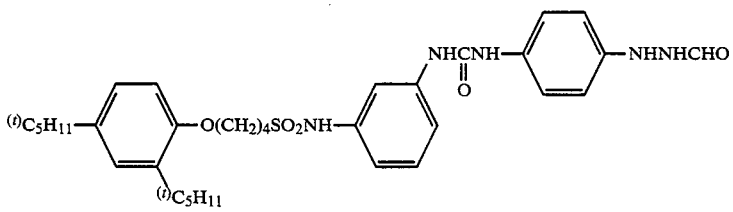
(N-45)
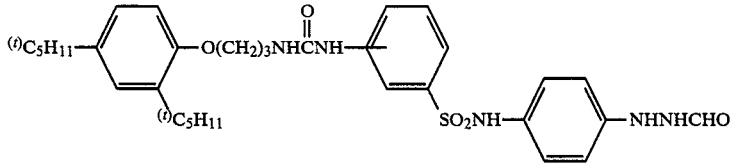
(N-46)
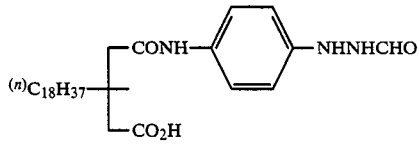

-continued
(N-47)
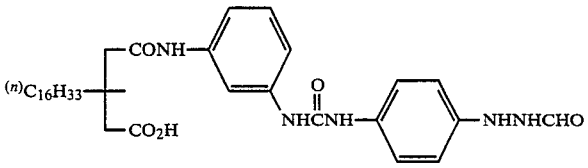
(N-48)
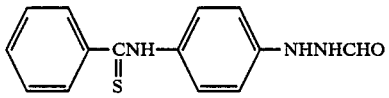
(N-49)
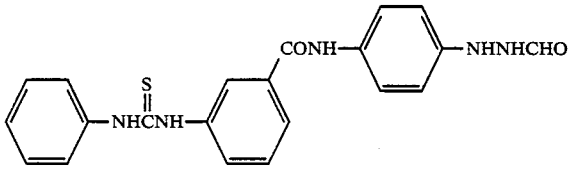
(N-50)
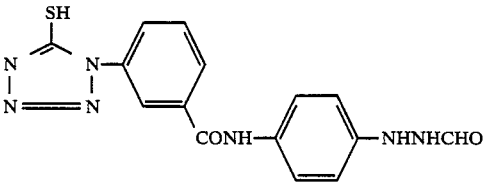
(N-51)
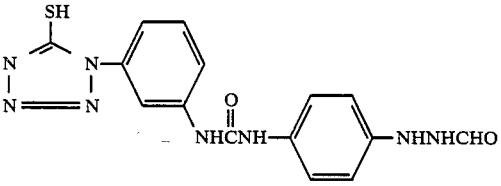
(N-52)
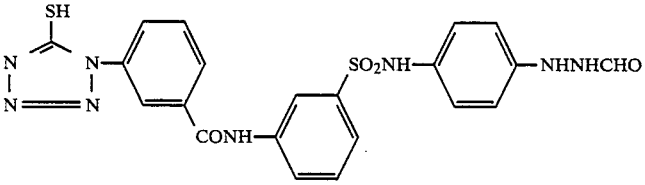
(N-53)
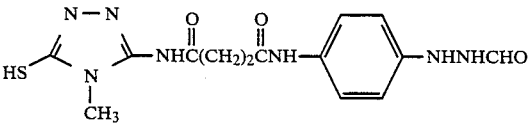
(N-54)
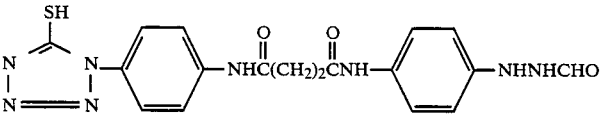
(N-55)
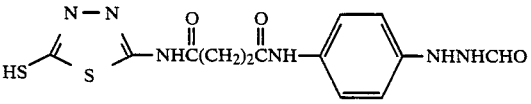
(N-56)
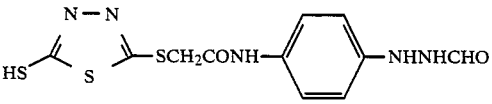

-continued

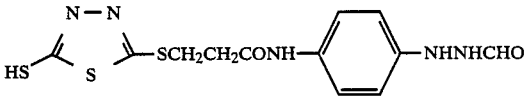
(N-57)

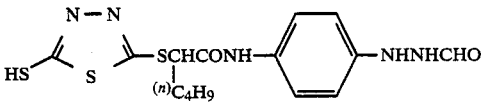
(N-58)

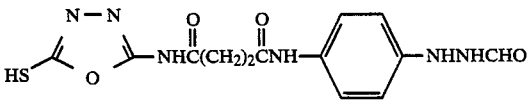
(N-59)

The synthesis methods for the compounds shown by formula (N-II), which are used in this invention, are described in the patents cited by *Research Disclosure,* RD No. 15162, pp. 76–77 (November, 1976), ibid., RD No. 22534, pp. 50–54 (January, 1983), and ibid., RD No. 23510, pp. 346–352 (November, 1983) and also in U.S. Pat. Nos. 4,080,207, 4,269,924, 4,276,364, 4,278,748, 4,385,108, 4,459,347, 4,478,928, 4,560,638, British Patent 2,011,391B, Japanese Patent Application (OPI) No. 179734/85, etc.

The color photographic materials for use in this invention can contain the following compounds for increasing the maximum image density, decreasing the minimum image density, improving the storage stability of the light-sensitive materials, and/or quickening the development therefor.

Examples of the compounds incorporated in the color photographic materials are hydroquinones (e.g., the compounds described in U.S. Pat. Nos. 3,227,552 and 4,279,987), chromans (e.g., the compounds described in U.S. Pat. No. 4,268,621, Japanese Patent Application (OPI) No. 103031/79, *Research Disclosure,* RD No. 18264, pp. 333–334 (June, 1979), quinones (e.g., the compounds described in *Research Disclosure,* RD No. 21206, pp. 433–434 (December, 1981), amines (e.g., the compounds described in Japanese Patent Application (OPI) No. 174757 and U.S. Pat. No. 4,150,993), oxidants (e.g., the compounds described in Japanese Patent Application (OPI) No. 260039/85 and *Research Disclosure,* RD No. 16936, pp. 10–11 (May, 1978)), catechols (e.g., the compounds described in Japanese Patent Application (OPI) Nos. 21013/80 and 65944/80), compounds releasing a nucleating agent during development (e.g., the compounds described in Japanese Patent Application (OPI) No. 107029/85), thioureas (e.g, the compounds described in Japanese Patent Application (OPI) No. 95533/85), and spirobisindanes (e.g., the compounds described in Japanese Patent Application (OPI) No. 65944/80).

In this invention, tetraazaindenes, triazaindenes, and pentaazaindenes, each having at least one mercapto group substituted optionally by an alkali metal atom or ammonium group, or the compound represented by following formula (A-I) or (A-II) can be incorporated in the color photographic material, a nucleating bath, or a developer as a nucleating accelerator.

Formula (A-I) is represented as follows:

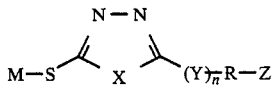
(A-I)

wherein M represents a hydrogen atom, an alkali metal atom, an ammonium group or a group cleaving under alkaline conditions; X represents an oxygen atom, a sulfur atom or a selenium atom; Y represents

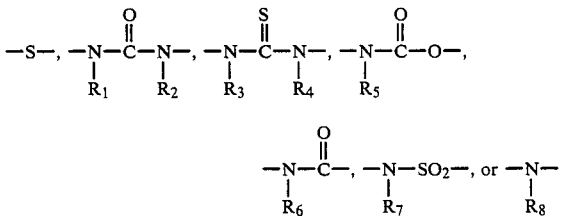

(wherein $R_1$, $R_2$, $R_3$, $R_4$, $R_5$, $R_6$, $R_7$, and $R_8$ each represents a hydrogen atom, a substituted or unsubstituted alkyl group, a substituted or unsubstituted aryl group, a substituted or unsubstituted alkenyl group, or a substituted or unsubstituted aralkyl group); R represents a straight chain or branched alkylene group, a straight chain or branched alkenylene group, a straight chain or branched aralkylene group, or an arylene group; Z represents a hydrogen atom, a halogen atom, a nitro group, a cyano group, a substituted or unsubstituted amino group, a quaternary ammonium group, an alkoxy group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a sulfonyloxy group, a ureido group, a thioureido group, an acyl group, a heterocyclic group, an oxycarbonyl group, an oxysulfonyl group, an oxycarbonylamino group, or a mercapto group; and n represents 0 to 1.

The nucleating accelerator of formula (A-II) is represented as follows:

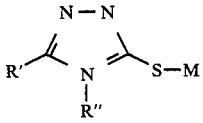
(A-II)

wherein R′ represents a hydrogen atom, a halogen atom, a nitro group, a mercapto group, an unsubstituted amino group, or —$(Y)_n$—R—Z (wherein Y, R, Z and n have the same meaning as defined above in formula (A-I)); R″ represents a hydrogen atom, an unsubstituted amino group or —$(Y')_m$—R—Z (wherein R and Z have the same meaning as above; Y′ represents

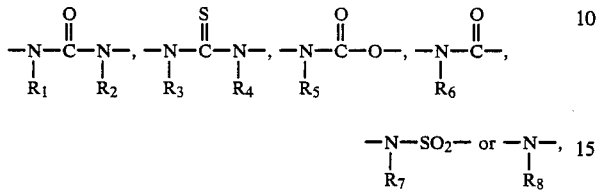

wherein $R_1$ $R_2$, $R_3$, $R_4$, $R_5$, $R_6$, $R_7$, and $R_8$ have the same meaning as defined above in formula (A-I); and m represents 0 or 1); and M has the same meaning as defined above in formula (A-I).

In formulae (A-I) and (A-II) described above, Z preferably represents a substituted or unsubstituted amino group, a quaternary ammonium group, an alkoxy group, an alkylthio group, or a heterocyclic group.

Specific examples of the nucleation accelerating agents which can be used in this invention are illustrated below, but the present invention is not limited to these (A-1)

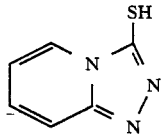

(A-2)

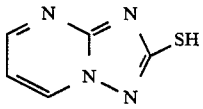

(A-3)

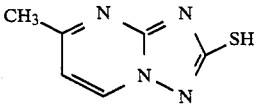

(A-4)

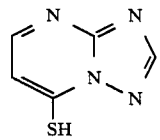

(A-5)

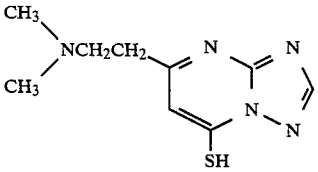

(A-6)

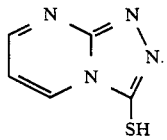

-continued (A-7)

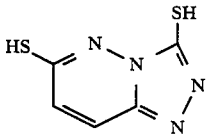

(A-8)

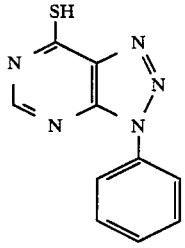

(A-9)

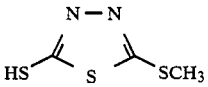

(A-10)

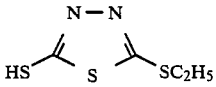

(A-11)

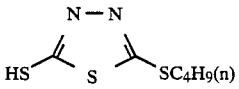

(A-12)

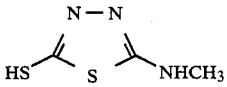

(A-13)

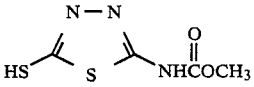

(A-14)

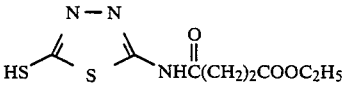

(A-15)

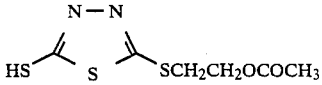

(A-16)

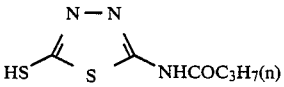

(A-17)

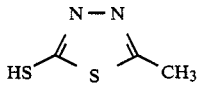

(A-18)

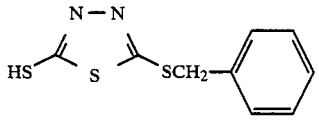

(A-19)

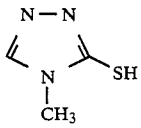

-continued
(A-20)
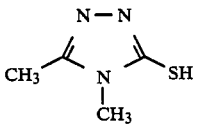
(A-21)
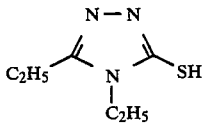
(A-22)
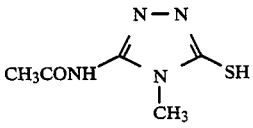
(A-23)
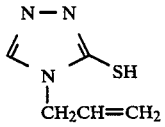
(A-24)
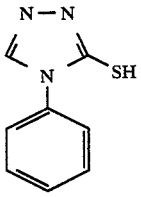
(A-25)
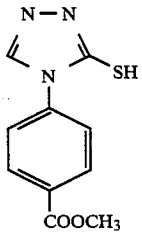
(A-26)
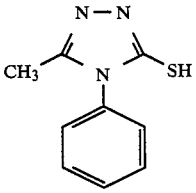
(A-27)
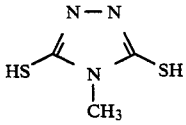
(A-28)
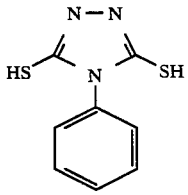
-continued
(A-29)
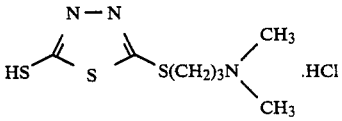
(A-30)
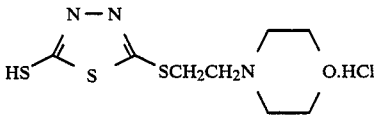
(A-31)
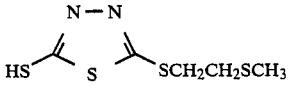
(A-32)
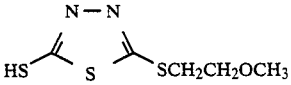
(A-33)
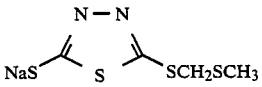
(A-34)
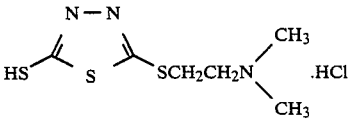
(A-35)
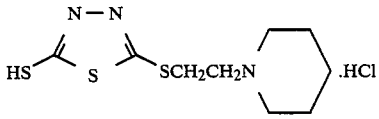
(A-36)
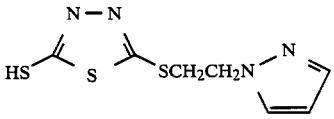
(A-37)
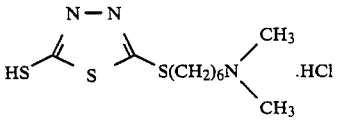
(A-38)
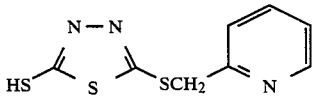
(A-39)
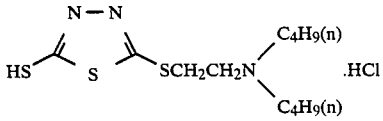
(A-40)
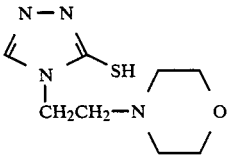

-continued (A-41)

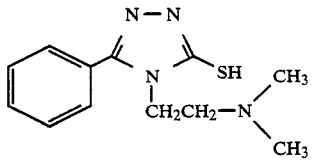

(A-42)

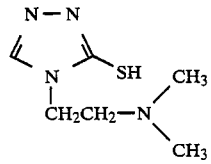

(A-43)

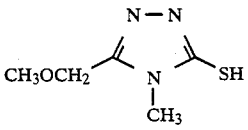

(A-44)

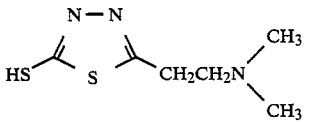

(A-45)

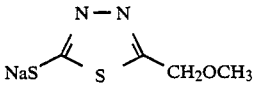

(A-46)

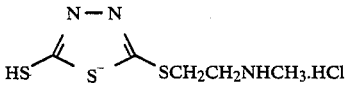

(A-47)

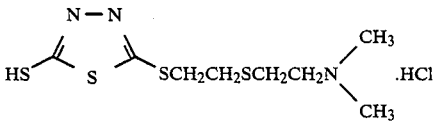

(A-48)

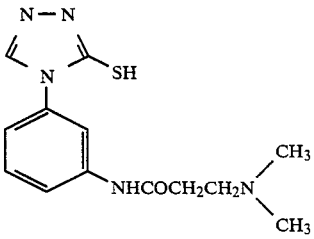

(A-49)

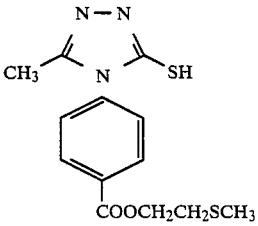

(A-50)

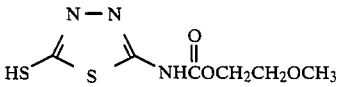

-continued (A-51)

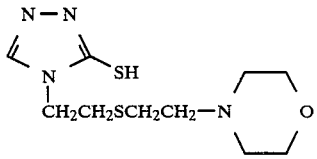

(A-52)

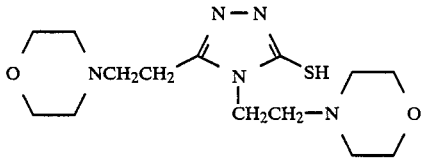

(A-53)

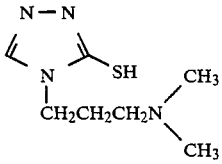

(A-54)

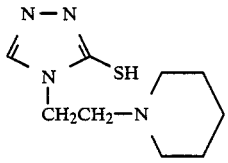

(A-55)

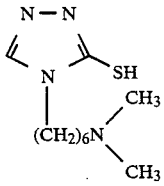

(A-56)

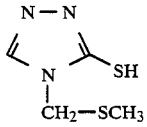

The color developer which is used for developing color photographic materials in this invention is an alkaline aqueous solution containing substantially no silver halide solvent and preferably containing an aromatic primary amino color developing agent as the main component. As the color developing agent, an aminophenol compound can be used, but a p-phenylene diamine compound is preferably used. Typical examples of such a p-phenylene diamine compound include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methylsulfonamidoethylaniline, 3-methyl-4-amino-N-ethyl-N-$\beta$-methoxyethylaniline, and sulfates, hydrochlorides, phosphates, p-toluenesulfonates, tetraphenylborates, and p-(t-octyl)benzenesulfonates thereof. These diamines are generally stable in the salt form rather than in the free state.

The present color developing agent is generally used in the concentration of from about 0.1 g to about 30 g, preferably about 1 g to about 15 g per 1 l of color developing solution The amount of the present color developing solution to be refilled can be reduced by using a refilling solution whose concentration of silver halide, color developing agent, or the like has been properly adjusted The present color development time is normally 5 minutes or less. In order to speed processing, color development time is preferably 2 minutes and 30 seconds or less, more preferably from 10 seconds to 2 minutes. If a sufficient color density can be obtained, a shorter color development time is preferably use. The pH thereof is not higher than 11.2 and preferably from 10.0 to 10.9.

Also, it is preferred that the color developer in this invention contains substantially no benzyl alcohol. If a color developer contains benzyl alcohol, it takes a long time to prepare the replenisher for the low-replenishing type color developer due to the low dissolution rate of benzyl alcohol and also tarry materials sometimes form. On the other hand, a color developer containing no benzyl alcohol has the advantage that the replenisher for the low-replenishing type color developer can be easily prepared since the time required for dissolving components is short, even when the color developer is of a low-replenishing type, and tarry materials do not form.

Also, by preventing the deviation of liquid composition or performing continuous processing using a color developer containing no benzyl alcohol, a constant finish without deviations in the degree of color stain is obtained without the formation of tarry materials, even when the amount of the replenisher is reduced to less than half (less than 165 ml/m$^2$) of the standard replenisher rate.

As additives for the color developer in this invention, various compounds described in Japanese Patent Application Nos. 1667/74, pp. 14–22 (corresponding to Japanese Patent Application (OPI) No. 144739/85), 118418/84, pp. 45–50 (corresponding to Japanese Patent Application (OPI) No. 242161/85), and 32462/86, pp. 11–22 can be used. Furthermore, it is particularly preferred to use nitrogen-containing heterocyclic compounds (e.g., tetraazaindenes, benzindazoles, benzotriazoles, benzimidazoles, benzothiazoles, benzoxazoles, 1-phenyl-5-mercaptotetrazoles, etc.), and aromatic or aliphatic mercapto compounds for the color developers in this invention as antifoggant.

After color development, the color photographic material is usually bleached. The bleaching process may be performed simultaneously with or separately from a fix process. Furthermore, for quickening photographic processing, a process of performing a bleach-fix (or blix) process after the bleaching process may be employed or a process of performing a blix process after the fix process may be employed.

The bleach liquid or blix liquid in this invention usually contains an aminopolycarboxylic acid iron complex salt. For the bleach liquid or blix liquid for use in this invention, various compounds described in Japanese Patent Application No. 32462/86, pp. 20–22 can be used as additives.

When the color developer does not contain benzyl alcohol, a leuco-forming reaction of cyan dye is not as likely to occur in a blix liquid, so that the pH of the blix liquid or the amount of an oxidant in the blix liquid can be reduced.

The amount of the replenisher for a blix liquid containing benzyl alcohol is usually from about 330 ml/m$^2$, but when a color developer does not contain benzyl alcohol, the amount of the replenisher can be reduced to below 60 ml/m$^2$.

After the desilvering step (the blix or fix step), the wash step and/or stabilization step is performed. For the wash step and the stabilization step, various compounds described in Japanese Patent Application No. 32462/86, pp. 30–36 can be used as additives.

The amount of replenisher for each processing step is preferably as small as possible. The amount of replenisher is preferably from 0.1 to 50 times, and more preferably from 3 to 30 times the amount of a processing liquid carried by a unit area of color photographic material from a pre-bath.

Preferred embodiments of the nucleating agents shown by formulae (N-I) and (N-II) described above, which can be effectively used in this invention, are as follows.

(1) The nucleating agent of formula (N-I), wherein the heterocyclic ring completed by Z is a quinolium nucleus, a benzothiazolium nucleus, a benzimidazolium nucleus, a pyridinium nucleus, an acridinium nucleus, a phenanthridinium nucleus, or an isoquinolinium nucleus.

(2) The nucleating agent of formula (N-I), wherein the adsorption accelerating group for silver halide shown by $X^1$ is a thioamido group, a heterocyclic mercapto group or a nitrogen-containing heterocyclic group forming imino silver.

(3) The nucleating agent of formula (N-I), wherein the heterocyclic ring completed by Z is a quinolinium group, a benzothiazolium group, or a benzimidazolium group.

(4) A more preferred nucleating agent of formula (N-I) is one wherein the heterocyclic ring completed by Z is a quinolinium group or a benzothiazolium group.

(5) The most preferred nucleating agent of formula (N-I) is one wherein the heterocyclic ring completed by Z is a quinolinium group.

(6) The nucleating agent of formula (N-I), wherein $R^1$, $R^2$ or Z has an alkinyl group as substituent.

(7) A more preferred nucleating agent of (6) is one wherein the heterocyclic ring completed by Z is quinolinium.

(8) A more preferred nucleating agent of (7) is one wherein the nucleating agent has an adsorption accelerating group for silver halide shown by $X^1$.

(9) A more preferred nucleating agent of (8) is one wherein the adsorption accelerating agent for silver halide is composed of a thioamido group, a heterocyclic mercapto group or a nitrogen-containing heterocyclic ring forming imino silver.

(10) The nucleating agent of formula (N-II), wherein the group shown by G-$R^{22}$ is a formyl group.

(11) A more preferred nucleating agent of formula (N-II) is one wherein $R^{23}$ and $R^{24}$ are a hydrogen atom and the group represented by G-$R^{22}$ is a formyl group.

(12) The nucleating agent of formula (N-II), wherein $R^{21}$ is an aromatic group and the group has a ureido group as a substituent.

(13) The nucleating agent of formula (N-II), wherein $R^{21}$ is an aromatic group and the group has an adsorption accelerating group for silver halide composed of a heterocyclic mercapto group, an arylmercapto group, an aliphatic mercapto group, or a nitrogen-containing heterocyclic ring forming imino silver as a substituent.

(14) A more preferred nucleating agent of (11) is one wherein $R^{21}$ is an aromatic group and the group has an adsorption accelerating group for silver halide composed of a heterocyclic mercapto group or a nitrogen-containing heterocyclic ring forming imino silver, or a ureido group as a substituent.

The following examples are intended to illustrate this invention more practically, but are not to be construed as limiting upon it in any way.

Unless otherwise specified therein, all parts, ratios and percents are by weight.

EXAMPLE 1

(1) Preparation of Emulsion

Emulsions I to XI were prepared as follows.

Emulsion I

An aqueous solution of potassium bromide and an aqueous solution of silver nitrate were simultaneously added to an aqueous gelatin solution with vigorous stirring at 75° C. over a period of about 40 minutes to provide an octahedral monodispersed silver bromide emulsion having a mean grain size of 0.4 μm.

To the emulsion was added 4 mg of sodium thiosulfate and 4 mg of chloroauric acid (tetrahydrate) per mol of the silver in the emulsion and the mixture was heated to 75° C. for 80 minutes to perform chemical sensitization. The silver bromide grains thus obtained were further treated as cores under the same precipitation conditions as above for 40 minutes to further growth of the crystals, whereby an octahedral monodispersed core/shell silver bromide emulsion having a mean grain size of 0.6 μm was finally obtained.

After washing with water and desalting the silver halide emulsion, sodium thiosulfate was added to the emulsion in an amount of 0.9 mg per mol of silver and the mixture was heated to 65° C. for 60 minutes to perform chemical sensitization, whereby an internal latent image-type silver halide emulsion I was obtained.

Emulsion II

After adding 30 g of gelatin to one liter of an aqueous solution containing 0.5 mol/liter of KBr, 0.2 mol/liter of NaCl and 0.0015 mol/liter of KI and dissolving the gelatin, 700 ml of an aqueous solution containing 1 mol/liter of silver nitrate was added thereto at 60° C. over a period of 20 minutes and physical ripening was performed for another 20 minutes. Then, the mixture was washed with water to remove water-soluble halides. Thereafter, 20 g of gelatin was added thereto and then water was added to make 1,200 ml.

Thus, a silver halide emulsion having a mean grain size of 0.4 μm was obtained. The emulsion was washed with water and subjected to desalting to provide an internal latent image type emulsion II.

Emulsion III

After adding 30 g of gelatin to one liter of an aqueous solution containing 0.5 mol/liter of KBr, 0.2 mol/liter of NaCl, and 0.0015 mol/liter of KI and dissolving gelatin, 700 ml of an aqueous solution containing 1 mol/liter of silver nitrate was added thereto at 60° C. over a period of 20 minutes and physical ripening was performed for another 20 minutes.

Then, the emulsion was washed with water to remove water-soluble halides, 20 g of gelatin was added thereto, and then water was added to make 1,200 ml.

Thus, a silver halide emulsion having a mean grain size of 0.4 μm was obtained.

To 300 ml of the emulsion were simultaneously added 500 ml of an aqueous solution of 1 mol/liter of silver nitrate and 500 ml of an aqueous solution of 2 mols/liter of sodium chloride at 60° C. to precipitate a silver chloride shell onto the silver halide grains of the silver halide emulsion. Then the emulsion was washed with water.

Thus, emulsion III having a mean grain size of 0.7 μm was obtained.

Emulsion IV

To an aqueous gelatin solution were simultaneously added an aqueous solution of potassium bromide and an aqueous solution of silver nitrate with vigorous stirring at 75° C. over a period of about 90 minutes to provide a regular octahedral silver bromide emulsion having a mean grain size of about 0.8 μm (core grains). In this case, however, before precipitation of the silver halide grains of the emulsion, 0.65 g of 3,4-dimethyl-1,3-thiazoline-2-thione was added to the aqueous gelatin solution, the pH of the system was kept at about 6, and the pAg was kept at about 8.7. Then, by adding 3.4 mg of sodium thiosulfate and 3.4 mg of potassium chloroaurate to the silver bromide grains per mol of silver, chemical sensitization was performed. Then crystal growth was further performed on the silver halide grains thus chemically sensitized under the same precipitation conditions as during core grain formation to form, finally, a regular octahedral core/shell silver bromide grains having a mean grain size of 1.2 μm. Furthermore, $9.6\times10^{-4}$ mol of potassium iodide per mol of silver and $4.2\times10^{-2}$ g of an N-vinylpyrrolidone polymer (having a mean molecular weight of 38,000) per mol of silver, were added to the aforesaid silver halide emulsion to provide emulsion IV.

Emulsion V

By simultaneously adding an aqueous solution of potassium bromide and an aqueous solution of silver nitrate to an aqueous gelatin solution containing potassium bromide with vigorous stirring at 75° C. over a period of about 60 minutes, a silver bromide emulsion was obtained. Before performing precipitation (before simultaneous mixing), 150 mg of 3,4-dimethyl-1,3-thiazoline-2-thione and 15 g of benzimidazole per mol of silver were added to the aqueous gelatin solution as a silver halide solvent.

After precipitation was completed, octahedral silver bromide crystals having uniform grain size of about 0.8 μm mean grain size were formed. To the silver halide grains were then added 4.8 mg of sodium thiosulfate and 2.4 mg of potassium chloroaurate per mol of silver and the mixture was heated to 75° C. for 80 minutes to perform chemical sensitization.

To the silver bromide emulsion (core) thus chemically sensitized were simultaneously added an aqueous solution of potassium bromide and an aqueous solution of silver nitrate as described above over a period of 45 minutes to precipitate an internal latent image type-core/shell silver halide emulsion. Then 2.5 g of hydrogen peroxide was added to the emulsion per mol of silver as an oxidizing agent and, after heating the mixture to 75° C. for 8 minutes, the mixture was washed with water to provide a silver halide emulsion having a mean grain size of 1.0 μm.

To the thus obtained latent image-type core/shell silver bromide emulsion were added 0.75 mg of sodium thiosulfate and 20 mg of poly(N-vinylpyrrolidone) per mol of silver and the resultant mixture was heated to 60°

C. for 60 minutes to perform chemical sensitization (ripening) of the grain surfaces to provide emulsion V.

Emulsion VI

An aqueous solution of potassium bromide and an aqueous solution of silver nitrate were simultaneously added to an aqueous gelatin solution containing 0.3 g of 3,4-dimethyl-1,3-thiazoline-2-thione per mol of silver with vigorous stirring at 75° C. over a period of about 20 minutes to provide an octahedral monodispersed silver bromide emulsion having a mean grain size of 0.4 μm (variation coefficient: 11%).

To the silver halide emulsion were added 6 mg of sodium thiosulfate and 6 mg of chloroauric acid (tetrahydrate) per mol of silver and the mixture was heated to 75° C. for 80 minutes to perform chemical sensitization.

Crystal growth was further performed on the silver halide grains (core) thus formed by applying the same precipitation process as above to the emulsion for 40 minutes to finally provide an octahedral monodispersed core/shell silver bromide emulsion having a mean grain size of 0.7 μm. After washing with water and desalting the emulsion, 1.5 mg of sodium thiosulfate and 1.5 mg of chloroauric acid (tetrahydrate) per mol of silver were added to the emulsion and the mixture was heated to 60° C. for 60 minutes to perform chemical sensitization, whereby an internal latent image-type silver halide emulsion VI was obtained.

Emulsion VII

By following the same procedure as in the case of producing Emulsion VI, except that chemical sensitization was applied to the octahedral monodispersed silver bromide emulsion of 0.4 μm in mean grain size obtained first in the aforesaid case by adding thereto 15 mg of sodium thiosulfate and 15 mg of chloroauric acid (tetrahydrate) per mol of silver in place of adding thereto 6 mg of each additive, respectively, and surface chemical sensitization was applied to the core/shell silver bromide emulsion obtained by adding thereto 6 mg of sodium thiosulfate and 6 mg of chloroauric acid (tetrahydrate) per mol of silver in place of adding thereto 1.5 mg of each additive, respectively, an internal latent image type silver halide emulsion VII was obtained.

Emulsion VIII

By following the same procedure as in the case of producing Emulsion V, except that surface chemical sensitization was applied to the internal latent image-type core/shell silver bromide emulsion obtained in the aforesaid case by adding 2.0 mg of chloroauric acid and 2.0 mg of sodium thiosulfate per mol of silver in place of adding 0.75 mg of sodium thiosulfate and also poly(N-vinylpyrrolidone) was not added to the emulsion, an internal latent image-type silver halide emulsion VIII was obtained.

Emulsion IX

By following the same procedure as in the case of producing Emulsion VI except that surface chemical sensitization was applied to the internal latent image-type core/shell silver halide emulsion obtained by adding thereto 6 mg of sodium thiosulfate and without adding chloroauric acid (tetrahydrate) in place of adding thereto 1.5 mg of sodium thiosulfat and 1.5 mg of chloroauric acid (tetrahydrate) per mol of silver, an internal latent image-type silver halide emulsion IX was obtained.

Emulsion X

By following the same procedure as that used to prepare Emulsion VI except that surface chemical sensitization was applied to the internal latent image-type core/shell silver halide emulsion obtained by adding thereto, 12 mg of sodium sulfate and without adding chloroauric acid (tetrahydrate) in place of adding thereto 1.5 mg of sodium thiosulfate and 1.5 mg of chloroauric acid (tetrahydrate) per mol of silver, an internal latent image-type silver halide emulsion X was obtained.

Emulsion XI

By following the same procedure as in the case of producing Emulsion VI, except that surface chemical sensitization was applied to the internal latent image type core/shell silver halide emulsion obtained by adding thereto 3 mg of sodium thiosulfate and 15 mg of poly(N-vinylpyrrolidone) (mean molecular weight of 38,000) per mol of silver and without adding potassium chloroaurate (tetrahydrate) in place of adding thereto 1.5 mg of sodium thiosulfate and 1.5 mg of chloroauric acid (tetrahydrate) per mol of silver, an internal latent image-type silver halide emulsion XI was obtained.

Multilayer color photographic papers "I-a~c to XI-a~c" (each of which are prepared according to a to c in Table 1 below) were prepared by forming the layers of the layer structure as shown below on a paper support both surfaces of which had been laminated by polyethylene using each of the aforesaid internal latent image type silver halide emulsions I to XI prepared above In this case, the polyethylene layer on the emulsion-carrying side of the support contained $TiO_2$, etc., as white pigment and ultramarine blue, etc., as bluish dye.

The coating compositions for the layers were prepared as follows.

Preparation of Coating Composition for Layer 1

To 10 g of cyan coupler (a) and 2.3 g of a color image stabilizer (b) were added 10 ml of ethyl acetate and 4 ml of solvent (c) and, after dissolving the components, the solution was dispersed by emulsification in 90 ml of an aqueous 10% gelatin solution containing 5 ml of an aqueous solution of 10% sodium dodecylbenzenesulfonate. On the other hand, by adding the red-sensitive dye shown below to the aforesaid silver halide emulsion (containing 70 g/kg of silver) in an amount of $2.0\times10^{-4}$ mol per mol of the silver halide, 90 g of a red-sensitive silver halide emulsion was prepared The aforesaid emulsified dispersion of the coupler was mixed with the aforesaid silver halide emulsion and a development accelerator. Then the concentration of gelatin in the mixture was adjusted as shown below and, further, a nucleating agent and a nucleation accelerating agent were added thereto as shown in Table 2 below as a to c to provide a coating composition for Layer 1.

Coating compositions for Layer 2 to Layer 7 were also prepared in a manner similar to the aforesaid method. For each layer, 1-oxy-3,5-dichloro-s-triazine sodium salt was used as a gelatin hardening agent.

As spectral sensitizers for the emulsion layers, the following dyes were used.

Red-Sensitizing Dye:

-continued

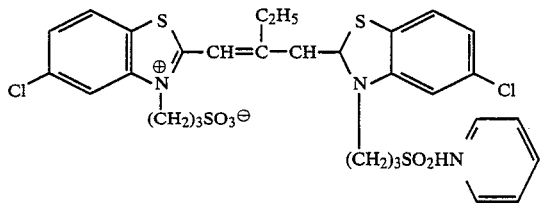

Green-Sensitizing Dye:

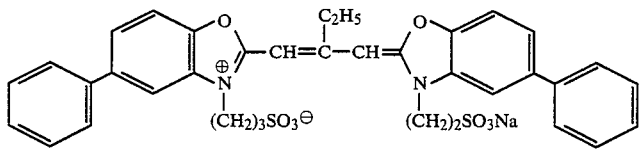

Blue-Sensitizing Dye:

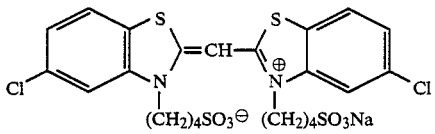

Also, the following dyes were used as irradiation preventing dyes for the emulsion layers.

Irradiation Preventing Dye for the Green-Sensitive Emulsion Layer:

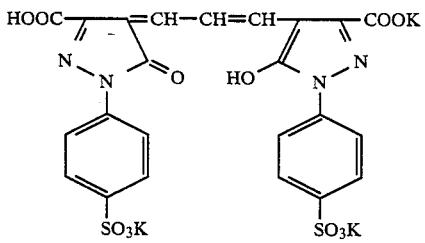

Irradiation Preventing Dye for the Red-Sensitive Emulsion Layer:

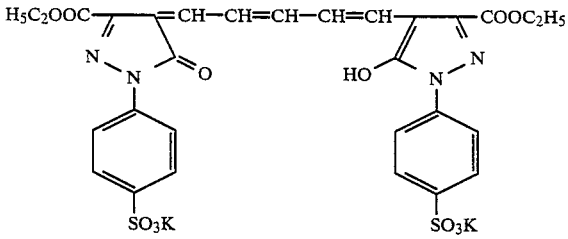

| Layer Structure | | |
|---|---|---|
| Layer 1: | | |
| Red-Sensitive Emulsion Layer | | |
| Silver halide emulsion | 0.39 | $g/m^2$ as silver |
| Gelatin | 0.90 | $g/m^2$ |
| Cyan Coupler (a) | $7.05 \times 10^{-4}$ | $mol/m^2$ |
| Color Image Stabilizer (b) | $5.20 \times 10^{-4}$ | $mol/m^2$ |
| Solvent (c) | 0.22 | $g/m^2$ |
| Development Accelerator (d) | 32 | $mg/m^2$ |
| Nucleating Agent and Nucleation Accelerator | (shown in Table 1) | |
| Layer 2: | | |
| Color Mixing Preventing Layer: | | |
| Gelatin | 0.90 | $g/m^2$ |
| Colloid Silver | 0.02 | $g/m^2$ as silver |
| Color Mixing Preventing Agent (e) | $2.33 \times 10^{-4}$ | $mol/m^2$ |
| Layer 3: | | |
| Green-Sensitive Emulsion Layer | | |
| Silver halide emulsion | 0.17 | $g/m^2$ as silver |
| Gelatin | 1.56 | $g/m^2$ |
| Magenta Coupler (f) | $3.38 \times 10^{-4}$ | $mol/m^2$ |
| Color Image Stabilizer (g) | 0.19 | $g/m^2$ |
| Solvent (h) | 0.59 | $g/m^2$ |
| Development Accelerator (d) | 32 | $mg/m^2$ |
| Nucleating Agent and Nucleation Accelerator | (shown in Table 1) | |
| Layer 4: | | |
| Ultraviolet Absorptive Layer: | | |
| Gelatin | 1.60 | $g/m^2$ |
| Colloid Silver | 0.10 | $g/m^2$ as silver |
| Ultraviolet Absorbent (i) | $1.70 \times 10^{-4}$ | $mol/m^2$ |
| Color Mixing Preventing Agent (j) | $1.60 \times 10^{-4}$ | $mol/m^2$ |
| Solvent (k) | 0.24 | $g/m^2$ |
| Layer 5: | | |
| Blue-Sensitive Emulsion Layer | | |
| Silver halide emulsion | 0.40 | $g/m^2$ as silver |
| Gelatin | 1.35 | $g/m^2$ |
| Yellow Coupler (l) | $6.91 \times 10^{-4}$ | $mol/m^2$ |
| Color Image Stabilizer (m) | 0.13 | $g/m^2$ |
| Solvent (h) | 0.02 | $g/m^2$ |
| Development Accelerator (d) | 32 | $mg/m^2$ |
| Nucleating Agent and Nucleation Accelerator | (shown in Table 1) | |
| Layer 6: | | |
| Ultraviolet Absorptive Layer: | | |
| Gelatin | 0.54 | $g/m^2$ |
| Ultraviolet Absorbent (i) | $5.10 \times 10^{-4}$ | $mol/m^2$ |
| Solvent (k) | 0.08 | $g/m^2$ |
| Layer 7: Protective Layer: | | |
| Gelatin | 1.33 | $g/m^2$ |
| Latex Particles of Methyl Polymethacrylate (mean particle size of 2.8 μm) | 0.05 | $g/m^2$ |
| Acryl-Modified Copolymer of | | |

-continued
| Layer Structure | |
|---|---|
| Polyvinyl Alcohol (modified degree of 17%) | 0.17 g/m$^2$ |
The structures of the compounds used in the example were as follows.
Cyan Coupler (a)
1:1 mixture (mol ratio) of
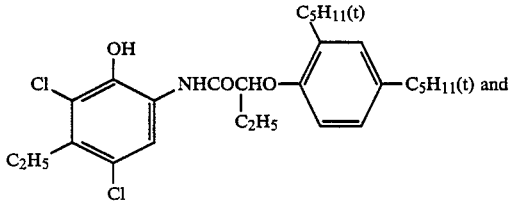
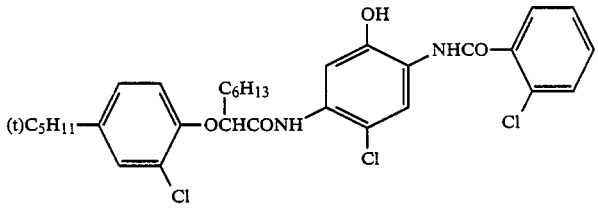
Color Image Stabilizer (b):
1:3:3 mixture (mol ratio) of
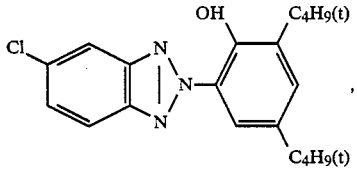
,
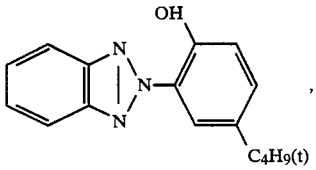
, and
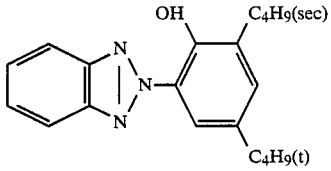
Solvent (c):
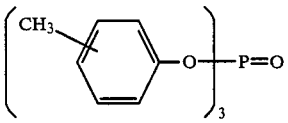
Development Accelerator (d):
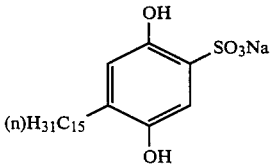
Color Mixing Preventing Agent (e):

-continued
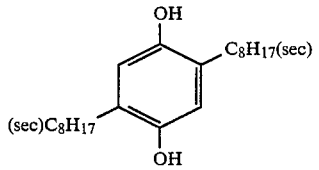
Magenta Coupler (f):
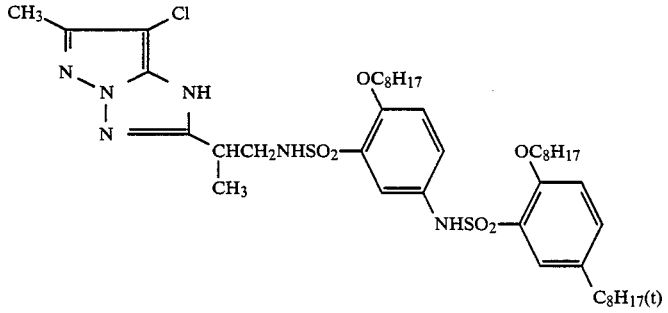
Color Image Stabilizer (g):
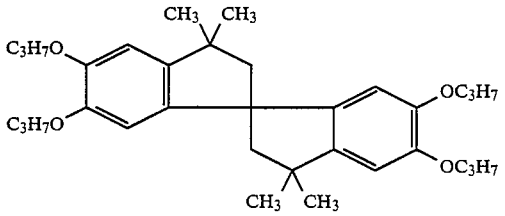
Solvent (h)
2:1 mixture (weight ratio) of
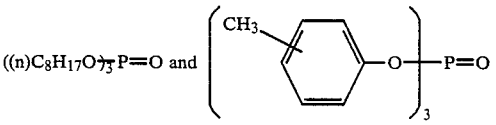
Ultraviolet Absorbent (i):
1:5:3 mixture (mol ratio) of
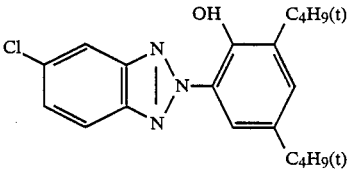
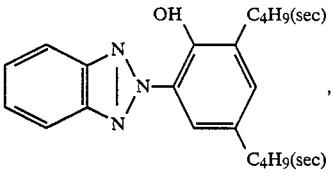
, and
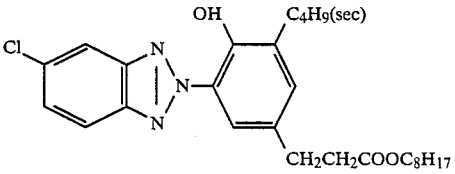
Color Mixing Preventing Agent (j):

-continued

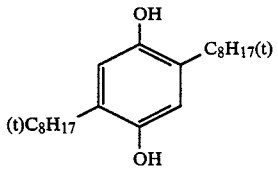

Solvent (k):

$(iso C_9H_{19}O)_3P{=}O$

Yellow Coupler (l):

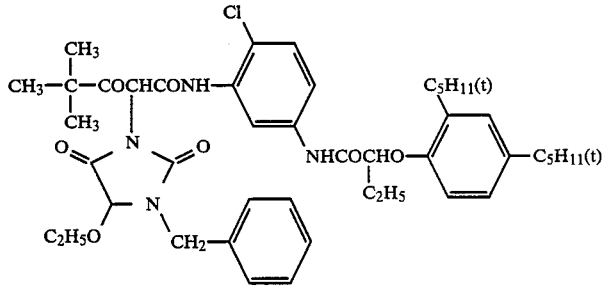

Color Image Stabilizer (m):

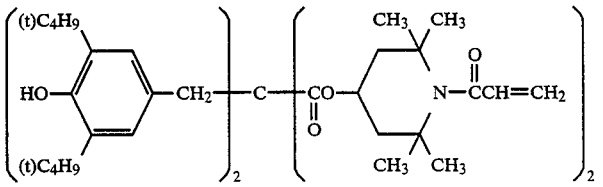

TABLE 1

| | Nucleating Agent | Nucleation Accelerator |
|---|---|---|
| a | none | none |
| b | 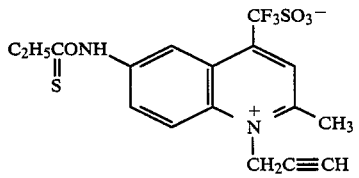 | 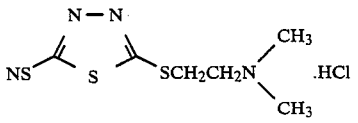 |
| | ($2 \times 10^{-7}$ mol/Ag 1 mol) | ($7 \times 10^{-4}$ mol/Ag 1 mol) |
| c | 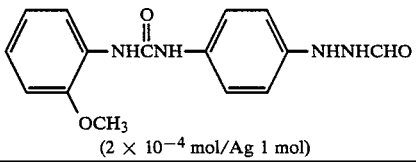 | 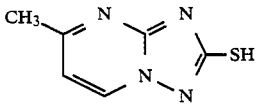 |
| | ($2 \times 10^{-4}$ mol/Ag 1 mol) | ($7 \times 10^{-4}$ mol/Ag 1 mol) |

The 33 color photographic papers I to XI (each a to c) thus prepared were subjected to following processing steps (a) to (d) and the maximum color image density of cyan for each sample was measured The results obtained are shown in Tables 2 and 3.

| | Processing Step (a): Time | Temperature |
|---|---|---|
| Color Development | 1 min. 30 sec | 33° C. |
| Blix | 1 min. 30 sec | 33° C. |
| Stabilization (1) | 1 min. | 33° C. |
| Stabilization (2) | 1 min. | 33° C. |

-continued

| | Processing Step (a): Time | Temperature |
|---|---|---|
| Stabilization (3) | 1 min. | 33° C. |

As the replenishing system for the stabilizer, a so called countercurrent replenishing system of supplying the fresh replenisher to the stabilization bath (3), which involves introducing fresh replenisher to stabilizer bath (3), introducing the overflow from stabilization bath (3) into stabilization bath (2), and then introducing the overflow from stabilization bath (2) into stabilization bath (1).

The compositions for the processing liquids used in the above processing steps were as follows.

| | (mother liquid) |
|---|---|
| Color Developer | |
| Diethylenetriaminepentaacetic Acid | 2.0 g |
| Benzyl Alcohol | 12.8 g |
| Diethylene Glycol | 3.4 g |
| Sodium Sulfite | 2.0 g |
| Sodium Bromide | 0.26 g |
| Hydroxylamine Sulfate | 2.60 g |
| Sodium Chloride | 3.20 g |
| 3-Methyl-4-amino-N—ethyl-N—(β-methane-sulfonamidoethyl)-aniline | 4.25 g |
| Potassium Carbonate | 30.0 g |
| Optical Whitening Agent (stilbene series) | 1.0 g |
| Water to make | 1 liter |
| pH adjusted with potassium hydroxide or hydrochloric acid to | 11.5 |
| Blix Liquid | |
| Ammonium Thiosulfate | 110 g |
| Sodium hydrogen Sulfite | 10 g |
| Diethylenetriaminepentaacetic Acid Iron (III) Ammonium Monohydrate | 56 g |
| Ethyenediaminetetraacetic Acid 2 $Na^+$Dihydate | 5 g |
| 2-Mercapto-1,3,4-triazole | 0.5 g |
| Water to make | 1 liter |
| pH adjusted by aqueous ammonia or hydrochloric acid to | 6.5 |
| Stabilization Liquid | |
| 1-Hydroxyethylidene-1,1'-diphosphonic Acid (60%) | 1.6 g |
| Bismuth Trichloride | 0.35 g |
| Polyvinylpyrrolidone | 0.25 g |
| Aqueous Ammonia | 2.5 ml |
| Nitrilotriacetic acid.3 $Na^+$ | 1.0 g |
| 5-Chloro-2-methyl-4-isothiazoline-3-one | 50 mg |
| 2-Octyl-4-isothiazolin-3-one | 50 mg |
| Optical Whitening Agent (4,4'-diamino-stilbene series) | 1.0 g |
| Water to make | 1 liter |
| pH adjusted to potassium hydroxide or hydrochloric acid to | 7.5 |

Processing Steps (b) and (c)

Same as Processing Step (a) except that the processing time and the pH of the color developer were changed as follows.

| | Processing Time | pH |
|---|---|---|
| Processing Step (b): | 2 min. 00 sec | 11.2 |
| Processing Step (c): | 3 min. 30 sec | 10.2 |
| | Processing Step (d): | |
| | Time | Temperature |
| Color Development | 2 min. 00 sec | 35° C. |
| Blix | 1 min. 00 sec | 35° C. |
| Stabilization (1) | 20 sec | 35° C. |
| Stabilization (2) | 20 sec | 35° C. |
| Stabilization (3) | 20 sec | 35° C. |

As the replenishing system for stabilization, a so-called countercurrent system of supplying the fresh replenisher to the stabilization bath (3), introducing the overflow from stabilization bath (3) into stabilization bath (2), and introducing the overflow from stabilization bath (2) into stabilization bath (1) was used.

In Processing Step (d), the following developing solutions were used:

| | (mother liquid) |
|---|---|
| Color Developer | |
| Diethylenetriaminepentaacetic Acid | 2.0 g |
| Sodium Sulfite | 0.3 g |
| Sodium Bromide | 0.26 g |
| Diethylenehydroxylamine | 4.0 g |
| 3-Methyl-4-amino-N—ethyl-N—(β-methane-sulfonamidoethyl)-aniline | 5.0 g |
| Potassium Carbonate | 30.0 g |
| Optical Whitening Agent (*1) | 3.0 g |
| Water to make | 1 liter |
| pH adjusted with potassium hydroxide or hydrochloric acid to | 10.2 |

(*1) Optical Whitening Agent

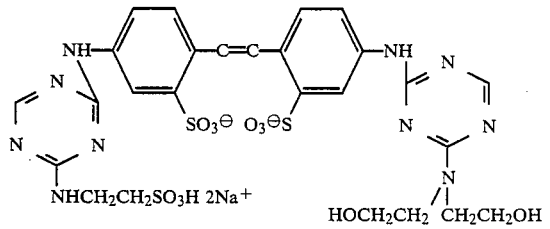

| | |
|---|---|
| Blix Liquid | |
| Ammonium Thiosulfate | 110 g |
| Sodium Hydrogen Sulfite | 10 g |
| Ethylenediaminetetraacetic Acid Iron (III) Ammonium Monohydrate | 56 g |
| Ethylenediaminetetraacetic Acid 2 $Na^+$.Dihydrate | 10 g |
| Acetic Acid (90%) | 12 ml |
| Water to make | 1 liter |
| pH adjusted by aqueous ammonia or hydrochloric acid to | 5.8 |

Wash

City water treated by a sodium type cationic exchange resin, SKIB (trade name, made by Mitsubishi Chemical Industries Ltd.) (containing 1 ppm calcium ion, and 0.3 ppm magnesium ion) was used for the wash step.

The aforesaid development times were employed so that the maximum densities of color images obtained for comparison almost coincided with each other. Also, color photographic papers I-a to XI-a containing no nucleating agent and nucleation accelerator were subjected to fogging treatment by a so-called light fogging method by applying light of 0.5 lux (5400K) for 10 seconds, 15 seconds after initiation of processing in the color developer in Processing Steps (a) to (d). These processing steps are shown in Table 2 as Processing Steps (a') to (d').

TABLE 2

| Light-Sensitive Material | Image Densities for Treatments (Light Fogging Method) a', b', c' and d' | | | |
|---|---|---|---|---|
| | a' | b' | c' | d' |
| I - a (Comparison) | 2.49 | 2.19 | 1.70 | 0.77 |
| II - a " | 2.47 | 2.00 | 1.24 | 0.50 |
| III - a " | 2.53 | 2.01 | 1.31 | 0.57 |
| IV - a " | 2.49 | 2.10 | 1.60 | 0.62 |
| V - a " | 2.50 | 2.30 | 1.95 | 1.88 |
| VI - a (Invention) | 2.51 | 2.53 | 2.49 | 2.53 |
| VII - a " | 2.51 | 2.48 | 2.40 | 2.35 |
| VIII - a " | 2.49 | 2.48 | 2.47 | 2.41 |
| IX - a (Comparison) | 2.20 | 2.00 | 1.35 | 0.70 |
| X - a " | 2.41 | 1.97 | 1.46 | 0.50 |

TABLE 2-continued

| Light-Sensitive Material | Image Densities for Treatments (Light Fogging Method) a', b', c' and d' | | | |
|---|---|---|---|---|
| | a' | b' | c' | d' |
| XI - a ″ | 2.55 | 2.31 | 1.74 | 0.99 |

TABLE 3

| Light-Sensitive Material | Image Densities for Treatments a, b, c and d | | | |
|---|---|---|---|---|
| | a | b | c | d |
| I - b (Comparison) | 2.53 | 2.20 | 1.88 | 1.14 |
| II - b ″ | 2.49 | 2.02 | 1.14 | 0.51 |
| III - b ″ | 2.50 | 2.00 | 1.09 | 0.48 |
| IV - b ″ | 2.60 | 2.10 | 1.46 | 0.80 |
| V - b ″ | 2.57 | 2.40 | 2.00 | 1.30 |
| VI - b (Invention) | 2.65 | 2.45 | 2.40 | 2.40 |
| VII - b ″ | 2.42 | 2.40 | 2.30 | 2.28 |
| VIII - b ″ | 2.70 | 2.61 | 2.51 | 2.48 |
| IX - b (Comparison) | 2.10 | 1.00 | 1.17 | 0.47 |
| X - b ″ | 2.50 | 1.85 | 1.10 | 0.50 |
| XI - b ″ | 2.51 | 2.00 | 1.27 | 0.70 |
| I - c (Comparison) | 2.60 | 1.89 | 1.20 | 0.70 |
| II - c ″ | 2.53 | 1.90 | 1.11 | 0.44 |
| III - c ″ | 2.45 | 1.78 | 1.21 | 0.47 |
| IV - c ″ | 2.60 | 1.50 | 1.22 | 0.60 |
| V - c ″ | 2.65 | 2.20 | 1.98 | 1.77 |
| VI - c (Invention) | 2.70 | 2.50 | 2.48 | 2.40 |
| VII - c ″ | 2.56 | 2.45 | 2.43 | 2.39 |
| VIII - c ″ | 2.66 | 2.57 | 2.56 | 2.50 |
| IX - c (Comparison) | 2.41 | 1.64 | 1.24 | 1.02 |
| X - c ″ | 2.60 | 1.59 | 1.35 | 1.00 |
| XI - c ″ | 2.49 | 1.80 | 1.40 | 0.98 |

a to c refer to a to c in Table 1 above.

From the results shown-in Tables 2 and 3 above, it can be seen that the color photographic papers VI to VIII (ac) which were subjected to the surface gold sensitization of this invention do not show much difference between other color photographic papers (I (a to c) to V (a to c) and IX (a to c) to XI (a to c) in Processing Step (a) (pH 11.5) but showed high color image density in Processing Steps (b) and (c) (pH 11.2 and 10.2).

Furthermore, in Processing Step (d) containing no benzyl alcohol, the color photographic papers in this invention gave sufficiently high color image density, even when they were processed by a developer having very low pH (10.2). In this case, the difference thereof from other comparison samples is apparent.

EXAMPLE 2

After accelerated aging of 33 color photographic papers I to XI (each a to c prepared as in Example 1) for 3 days at 40° C. and 80% relative humidity, the Processing Steps of (b') in Example 1 were applied to the color photographic papers I-a to XI-a and Processing Step (b) was applied to the color photographic papers I-b to XI-b and I-c to XI-c. The reduction in the cyan maximum color density by the aforesaid accelerated aging test is shown in Table 4 below. The lower the value for Reduction of Dmax, the greater the storage stability of the color photographic material in the

TABLE 4

| Light-Sensitive Material | Treatment | Reduction of Dmax after 3 Days at 40° C. and 80% RH |
|---|---|---|
| I - a (Comparison) | b' | 0.21 |
| II - a ″ | ″ | 0.61 |
| III - a ″ | ″ | 0.54 |

TABLE 4-continued

| Light-Sensitive Material | Treatment | Reduction of Dmax after 3 Days at 40° C. and 80% RH |
|---|---|---|
| IV - a ″ | ″ | 0.61 |
| V - a ″ | ″ | 0.15 |
| VI - a (Invention) | ″ | 0.04 |
| VII - a ″ | ″ | 0.03 |
| VIII - a ″ | ″ | 0.01 |
| IX - a (Comparison) | ″ | 0.35 |
| X - a ″ | ″ | 0.24 |
| XI - a ″ | ″ | 0.30 |
| I - b (Comparison) | b | 0.24 |
| II - b ″ | ″ | 0.52 |
| III - b ″ | ″ | 0.48 |
| IV - b ″ | ″ | 0.65 |
| V - b ″ | ″ | 0.22 |
| VI - b (Invention) | ″ | 0.07 |
| VII - b ″ | ″ | 0.06 |
| VIII - b ″ | ″ | 0.03 |
| IX - b (Comparison) | b | 0.46 |
| X - b ″ | ″ | 0.42 |
| XI - b ″ | ″ | 0.39 |
| I - c (Comparison) | b | 0.39 |
| II - c ″ | ″ | 0.87 |
| III - c ″ | ″ | 0.80 |
| IV - c ″ | ″ | 0.90 |
| V - c ″ | ″ | 0.29 |
| VI - c (Invention) | ″ | 0.06 |
| VII - c ″ | ″ | 0.04 |
| VIII - c ″ | ″ | 0.03 |
| IX - c (Comparison) | ″ | 0.37 |
| X - c ″ | ″ | 0.30 |
| XI - c ″ | ″ | 0.33 |

From the above results, it can be seen that the color photographic papers of this invention have excellent storage stability in the unexposed state when either the light fogging method and chemical fogging method were applied.

As described above, according to this invention, when processing a previously unfogged internal latent image-type silver halide color photographic material with a color developer having low pH, a direct positive color photographic image having high maximum coloring density can be formed quickly and stably.

Also, by processing a previously unfogged internal latent image-type silver halide color photographic material having very good storage stability in the unexposed state with a color developer having low pH, direct color images can be formed quickly and stably.

Furthermore, in this invention, even when the color photographic material is processed in a short period of time with a color developer containing substantially no benzyl alcohol, direct positive color photographic images showing less reduction in color density can be formed.

While the invention has been described in detail and with reference to specific embodiments thereof, it will be apparent to one skilled in the art that various changes and modifications can be made therein without departing from the spirit and scope thereof.

What is claimed is:

1. A process for forming direct positive color photographic images by developing, after imagewise exposure, a color photographic material having on a support at least one previously unfogged internal latent image-type silver halide emulsion layer and at least one color image forming coupler with a surface color developer containing an aromatic primary amine color developing agent, while applying thereto a fogging treatment, with or without the presence of a nucleating agent, before or during the development step, and bleaching and fixing (or blixing) the color photographic the pH of the surface color developer is not higher than 11.2, the color image forming coupler is a compound which is substantially non-diffusible and forms or releases a dye by causing oxidative coupling with the aromatic primary amine color developing agent, and the surface of the silver halide in the internal latent image-type silver halide emulsion has been gold-sensitized.

2. The process as claimed in claim 1, wherein the color developer contains substantially no benzyl alcohol.

3. The process as claimed in claim 1 or 2, wherein the fogging treatment for the color photographic material is performed by exposure to light.

4. The process as claimed in claim 1 or 2, wherein the fogging treatment for the color photographic material is performed by at least one nucleating agent selected from the compounds represented by following formulae (N-I) and (NII):

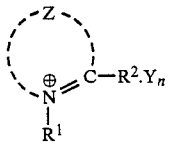

(N-I)

wherein Z represents a non-metallic atomic group necessary for forming a 5-membered or 6-membered heterocyclic ring;

$R^1$ represents an aliphatic group; and $R^2$ represents a hydrogen atom, an aliphatic group, or an aromatic group;

with the proviso that at least one of the groups represented by said Z, $R^1$ and $R^2$ includes an alkinyl group, an acyl group, a hydrazine group, or a hydrazone group or said $R^1$ and $R^2$ combine with each other to form a 6-membered ring to form a dihydropyridinium skeleton; and one or more of the substituents for said Z, $R^1$ and $R^2$ may contain a group represented by $X^1$-$(L^1)_m$-, wherein $X^1$ represents an adsorption accelerating group for silver halide, $L^1$ represents a divalent linking group, and m represents 0 or 1;

Y represents a paired ion for balancing the electric charge, so that the total charge on formula (N-I) equals zero;

and n represents 0 to 1;

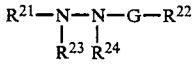

(N-II)

wherein $R^{21}$ represents an aliphatic group, an alicyclic group, an aromatic group or a heterocyclic group;

$R^{22}$ represents a hydrogen atom, an alkyl group, an aralkyl group, an aryl group, an alkoxy group, an aryloxy group or an amino group;

G represents a carbonyl group, a sulfonyl group, a sulfoxy group, a phosphoryl group, or an iminomethylene group

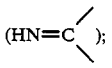

;

$R^{23}$ and $R^{24}$ both represent a hydrogen atom or one of them represents a hydrogen atom and the other represents an alkylsulfonyl group, an arylsulfonyl group or an acyl group; and said nucleating agent may form a hydrazone structure

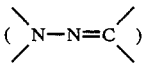

which includes said G, $R^{23}$, $R^{24}$ and hydrazine nitrogen in its structure.

* * * * *